US007090751B2

(12) United States Patent
Hanson

(10) Patent No.: US 7,090,751 B2
(45) Date of Patent: Aug. 15, 2006

(54) APPARATUS AND METHODS FOR ELECTROCHEMICAL PROCESSING OF MICROELECTRONIC WORKPIECES

(75) Inventor: Kyle M. Hanson, Kalispell, MT (US)

(73) Assignee: Semitool, Inc., Kalispell, MT (US)

( * ) Notice: Subject to any disclaimer, the term of this patent is extended or adjusted under 35 U.S.C. 154(b) by 271 days.

(21) Appl. No.: 10/234,442

(22) Filed: Sep. 3, 2002

(65) Prior Publication Data

US 2003/0070918 A1 Apr. 17, 2003

Related U.S. Application Data

(60) Provisional application No. 60/316,597, filed on Aug. 31, 2001.

(51) Int. Cl.

| | |
|---|---|
| ***C25D 17/00*** | (2006.01) |
| ***C25D 17/02*** | (2006.01) |
| ***C25F 7/00*** | (2006.01) |
| *C25D 7/12* | (2006.01) |
| *C25F 3/16* | (2006.01) |

(52) U.S. Cl. ..... 204/230.3; 204/242; 204/252; 204/259; 204/263

(58) Field of Classification Search ..... 204/224 R, 204/224 M, 198

See application file for complete search history.

(56) References Cited

U.S. PATENT DOCUMENTS

| | | | |
|---|---|---|---|
| 1,526,644 | A | 2/1925 | Pinney |
| 1,881,713 | A | 10/1932 | Laukel |
| 2,256,274 | A | 9/1941 | Boedecker et al. |
| 3,309,263 | A | 3/1967 | Grobe ..... 162/306 |
| 3,616,284 | A | 10/1971 | Bodmer et al. |
| 3,664,933 | A | 5/1972 | Clauss |
| 3,706,635 | A | 12/1972 | Kowalski |
| 3,706,651 | A | 12/1972 | Leland |
| 3,716,462 | A | 2/1973 | Jensen |
| 3,727,620 | A | 4/1973 | Orr |
| 3,798,003 | A | 3/1974 | Ensley et al. |
| 3,878,066 | A | 4/1975 | Dettke et al. |
| 3,930,963 | A | 1/1976 | Polichette et al. |
| 3,953,265 | A | 4/1976 | Hood |
| 3,968,885 | A | 7/1976 | Hassan et al. |
| 4,000,046 | A | 12/1976 | Weaver |

(Continued)

FOREIGN PATENT DOCUMENTS

| | | |
|---|---|---|
| CA | 873651 | 6/1971 |

(Continued)

OTHER PUBLICATIONS

Patent Abstract of Japan, "Organic Compound and its Application," Publciation No. 08-003153, Publication Date: Jan. 9, 1996.

(Continued)

*Primary Examiner*—Harry D. Wilkins, III
(74) *Attorney, Agent, or Firm*—Perkins Coie LLP

(57) ABSTRACT

A processing chamber comprising a reaction vessel having an electro-reaction cell including a virtual electrode unit, an electrode assembly disposed relative to the electro-reaction cell to be in fluid communication with the virtual electrode unit, and an electrode in the electrode assembly. The virtual electrode unit has at least one opening defining at least one virtual electrode in the electro-reaction cell. The electrode assembly can include an electrode compartment and an interface element in the electrode compartment. The interface element can be a filter, a membrane, a basket, and/or another device configured to hold the electrode. The interface element, for example, can be a filter that surrounds a basket in which the electrode is positioned.

12 Claims, 8 Drawing Sheets

U.S. PATENT DOCUMENTS

| | | | | | |
|---|---|---|---|---|---|
| 4,022,679 | A | | 5/1977 | Koziol et al. | |
| 4,046,105 | A | | 9/1977 | Gomez | |
| 4,082,638 | A | | 4/1978 | Jumer | |
| 4,113,577 | A | | 9/1978 | Ross et al. | |
| 4,132,567 | A | | 1/1979 | Blackwood | |
| 4,134,802 | A | | 1/1979 | Herr | |
| 4,170,959 | A | | 10/1979 | Aigo | |
| 4,222,834 | A | | 9/1980 | Bacon et al. | |
| 4,238,310 | A | * | 12/1980 | Eckler et al. | 204/252 |
| 4,276,855 | A | | 7/1981 | Seddon | |
| 4,286,541 | A | | 9/1981 | Blackwood | |
| 4,287,029 | A | | 9/1981 | Shimamura | |
| 4,323,433 | A | | 4/1982 | Loch | |
| 4,360,410 | A | | 11/1982 | Fletcher et al. | |
| 4,378,283 | A | | 3/1983 | Seyffert | |
| 4,384,930 | A | | 5/1983 | Eckles | |
| 4,391,694 | A | | 7/1983 | Runsten | |
| 4,431,361 | A | | 2/1984 | Bayne | |
| 4,437,943 | A | | 3/1984 | Beck | |
| 4,439,243 | A | | 3/1984 | Titus | |
| 4,439,244 | A | | 3/1984 | Allevato | |
| 4,449,885 | A | | 5/1984 | Hertel et al. | |
| 4,451,197 | A | | 5/1984 | Lange | |
| 4,463,503 | A | | 8/1984 | Applegate | |
| 4,469,566 | A | | 9/1984 | Wray | |
| 4,495,153 | A | | 1/1985 | Midorikawa | |
| 4,495,453 | A | | 1/1985 | Inaba | |
| 4,500,394 | A | | 2/1985 | Rizzo | |
| 4,544,446 | A | | 10/1985 | Cady | |
| 4,566,847 | A | | 1/1986 | Maeda | |
| 4,576,689 | A | | 3/1986 | Makkaev | |
| 4,585,539 | A | | 4/1986 | Edson | |
| 4,604,177 | A | | 8/1986 | Sivilotti | |
| 4,604,178 | A | | 8/1986 | Fiegener | |
| 4,634,503 | A | | 1/1987 | Nogavich | |
| 4,639,028 | A | | 1/1987 | Olson | |
| 4,648,944 | A | | 3/1987 | George | |
| 4,664,133 | A | | 5/1987 | Silvernail | |
| 4,670,126 | A | | 6/1987 | Messer et al. | |
| 4,678,545 | A | * | 7/1987 | Galik | 205/50 |
| 4,693,017 | A | | 9/1987 | Oehler et al. | |
| 4,715,934 | A | | 12/1987 | Tamminen | |
| 4,732,785 | A | | 3/1988 | Brewer | |
| 4,750,505 | A | | 6/1988 | Inuta | |
| 4,760,671 | A | | 8/1988 | Ward | |
| 4,761,214 | A | | 8/1988 | Hinman | |
| 4,770,590 | A | | 9/1988 | Hugues et al. | |
| 4,781,800 | A | | 11/1988 | Goldman | |
| 4,790,262 | A | | 12/1988 | Nakayama | |
| 4,800,818 | A | | 1/1989 | Kawaguchi et al. | |
| 4,828,654 | A | | 5/1989 | Reed | |
| 4,838,289 | A | | 6/1989 | Kottman | |
| 4,864,239 | A | | 9/1989 | Casarcia et al. | |
| 4,898,647 | A | | 2/1990 | Luce et al. | |
| 4,902,398 | A | | 2/1990 | Homstad | |
| 4,903,717 | A | | 2/1990 | Sumnitsch | |
| 4,906,341 | A | | 3/1990 | Yamakawa | |
| 4,924,890 | A | | 5/1990 | Giles et al. | |
| 4,944,650 | A | | 7/1990 | Matsumoto | |
| 4,949,671 | A | | 8/1990 | Davis | |
| 4,959,278 | A | | 9/1990 | Shimauch | |
| 4,962,726 | A | | 10/1990 | Matsushita et al. | |
| 4,982,215 | A | | 1/1991 | Matsuoka | |
| 4,982,753 | A | | 1/1991 | Grebinski | |
| 4,988,533 | A | | 1/1991 | Freeman | |
| 5,000,827 | A | | 3/1991 | Schuster | |
| 5,020,200 | A | | 6/1991 | Mimasaka | |
| 5,026,239 | A | | 6/1991 | Chiba | |
| 5,032,217 | A | | 7/1991 | Tanaka | |
| 5,054,988 | A | | 10/1991 | Shiraiwa | |
| 5,055,036 | A | | 10/1991 | Asano et al. | |
| 5,061,144 | A | | 10/1991 | Akimoto | |
| 5,078,852 | A | | 1/1992 | Yee | |
| 5,083,364 | A | | 1/1992 | Olbrich et al. | |
| 5,096,550 | A | | 3/1992 | Mayer | |
| 5,110,248 | A | | 5/1992 | Asano et al. | |
| 5,115,430 | A | | 5/1992 | Hahne | |
| 5,117,769 | A | | 6/1992 | DeBoer | |
| 5,125,784 | A | | 6/1992 | Asano | |
| 5,128,912 | A | | 7/1992 | Hug et al. | |
| 5,138,973 | A | | 8/1992 | Davis | |
| 5,146,136 | A | | 9/1992 | Ogura | |
| 5,151,168 | A | | 9/1992 | Gilton | |
| 5,156,174 | A | | 10/1992 | Thompson | |
| 5,156,730 | A | | 10/1992 | Bhatt | |
| 5,168,886 | A | | 12/1992 | Thompson et al. | |
| 5,168,887 | A | | 12/1992 | Thompson | |
| 5,172,803 | A | | 12/1992 | Lewin | |
| 5,174,045 | A | | 12/1992 | Thompson et al. | |
| 5,178,512 | A | | 1/1993 | Skrobak | |
| 5,178,639 | A | | 1/1993 | Nishi | |
| 5,180,273 | A | | 1/1993 | Salaya et al. | |
| 5,183,377 | A | | 2/1993 | Becker et al. | |
| 5,186,594 | A | | 2/1993 | Toshima et al. | |
| 5,209,180 | A | | 5/1993 | Shoda | |
| 5,209,817 | A | | 5/1993 | Ahmad | |
| 5,217,586 | A | | 6/1993 | Datta | |
| 5,222,310 | A | | 6/1993 | Thompson | |
| 5,224,503 | A | | 7/1993 | Thompson | |
| 5,224,504 | A | | 7/1993 | Thompson et al. | |
| 5,228,232 | A | | 7/1993 | Miles | |
| 5,228,966 | A | | 7/1993 | Murata | |
| 5,232,511 | A | | 8/1993 | Bergman | |
| 5,235,995 | A | | 8/1993 | Bergman et al. | |
| 5,238,500 | A | | 8/1993 | Bergman | |
| 5,252,137 | A | | 10/1993 | Tateyama et al. | |
| 5,256,262 | A | * | 10/1993 | Blomsterberg | 205/646 |
| 5,256,274 | A | | 10/1993 | Poris | |
| 5,301,700 | A | | 4/1994 | Kamikawa et al. | |
| 5,302,464 | A | | 4/1994 | Nomura | |
| 5,314,294 | A | | 5/1994 | Taniguchi | |
| 5,316,642 | A | | 5/1994 | Young | |
| 5,326,455 | A | | 7/1994 | Kubo et al. | |
| 5,332,445 | A | | 7/1994 | Bergman | |
| 5,349,978 | A | | 9/1994 | Sago | |
| 5,361,449 | A | | 11/1994 | Akimoto | |
| 5,363,171 | A | | 11/1994 | Mack | |
| 5,368,711 | A | | 11/1994 | Poris | |
| 5,372,848 | A | | 12/1994 | Blackwell | |
| 5,376,176 | A | | 12/1994 | Kuriyama | |
| 5,377,708 | A | | 1/1995 | Bergman | |
| 5,388,945 | A | | 2/1995 | Garric et al. | |
| 5,391,285 | A | | 2/1995 | Lytle et al. | 205/123 |
| 5,391,517 | A | | 2/1995 | Gelatos et al. | 437/190 |
| 5,393,624 | A | | 2/1995 | Ushijima | |
| 5,405,518 | A | | 4/1995 | Hsieh et al. | 204/297 |
| 5,411,076 | A | | 5/1995 | Matsunaga et al. | 165/80 |
| 5,421,893 | A | | 6/1995 | Perlov | |
| 5,421,987 | A | | 6/1995 | Tzanavaras et al. | |
| 5,427,674 | A | | 6/1995 | Langenskiold et al. | 205/88 |
| 5,429,686 | A | | 7/1995 | Chiu et al. | 139/383 |
| 5,429,733 | A | | 7/1995 | Ishida | |
| 5,431,421 | A | | 7/1995 | Thompson | |
| 5,431,803 | A | | 7/1995 | DiFranco et al. | 205/50 |
| 5,437,777 | A | | 8/1995 | Kishi | |
| 5,441,629 | A | | 8/1995 | Kosaki | 205/148 |
| 5,442,416 | A | | 8/1995 | Tateyama et al. | |
| 5,443,707 | A | | 8/1995 | Mori | 204/242 |
| 5,445,484 | A | | 8/1995 | Kato et al. | |
| 5,447,615 | A | | 9/1995 | Ishida | 204/224 |
| 5,454,405 | A | | 10/1995 | Hawes | 139/383 |
| 5,460,478 | A | | 10/1995 | Akimoto et al. | |
| 5,464,313 | A | | 11/1995 | Ohsawa | |
| 5,472,502 | A | | 12/1995 | Batchelder | |

5,474,807 A 12/1995 Koshiishi
5,489,341 A 2/1996 Bergman et al.
5,500,081 A 3/1996 Bergman
5,501,768 A 3/1996 Hermans et al. ..... 162/9
5,508,095 A 4/1996 Allum et al. ..... 428/242
5,510,645 A 4/1996 Fitch
5,512,319 A 4/1996 Cook et al. ..... 427/244
5,513,594 A 5/1996 McClanahan
5,514,258 A 5/1996 Brinket et al. ..... 204/237
5,516,412 A 5/1996 Andricacos et al.
5,522,975 A 6/1996 Andricacos et al. ..... 204/297
5,527,390 A 6/1996 Ono et al.
5,544,421 A 8/1996 Thompson et al.
5,549,808 A 8/1996 Farooq
5,551,986 A 9/1996 Jain
5,567,267 A 10/1996 Kazama et al. ..... 156/345
5,571,325 A 11/1996 Ueyama
5,575,611 A 11/1996 Thompson et al.
5,584,310 A 12/1996 Bergman
5,584,971 A 12/1996 Komino ..... 204/192
5,591,262 A 1/1997 Sago
5,593,545 A 1/1997 Rugowski et al. ..... 162/207
5,597,460 A 1/1997 Reynolds ..... 204/212
5,597,836 A 1/1997 Hackler et al. ..... 514/352
5,600,532 A 2/1997 Michiya et al. ..... 361/305
5,609,239 A 3/1997 Schlecker ..... 198/680
5,616,069 A 4/1997 Walker
5,620,581 A 4/1997 Ang
5,639,206 A 6/1997 Oda et al.
5,639,316 A 6/1997 Cabral
5,641,613 A 6/1997 Boff et al.
5,650,082 A 7/1997 Anderson ..... 219/390
5,651,823 A 7/1997 Parodi et al. ..... 118/500
5,658,183 A 8/1997 Sandhu
5,658,387 A 8/1997 Reardon
5,660,472 A 8/1997 Peuse et al. ..... 374/128
5,660,517 A 8/1997 Thompson et al.
5,662,788 A 9/1997 Sandhu
5,664,337 A 9/1997 Davis et al.
5,666,985 A 9/1997 Smith
5,670,034 A 9/1997 Lowery ..... 205/143
5,676,337 A 10/1997 Giras et al.
5,677,118 A 10/1997 Spara et al. ..... 430/555
5,677,824 A 10/1997 Harashima
5,678,116 A 10/1997 Sugimoto
5,678,320 A 10/1997 Thompson et al.
5,681,392 A 10/1997 Swain
5,683,564 A 11/1997 Reynolds
5,684,654 A 11/1997 Searle et al.
5,684,713 A 11/1997 Asada
5,700,127 A 12/1997 Harada
5,700,180 A 12/1997 Sandhu
5,711,646 A 1/1998 Ueda et al.
5,718,763 A 2/1998 Tateyama
5,719,495 A 2/1998 Moslehi
5,723,028 A 3/1998 Poris
5,731,678 A 3/1998 Zila et al.
5,744,019 A 4/1998 Ang ..... 205/96
5,746,565 A 5/1998 Tepolt
5,747,098 A 5/1998 Larson ..... 427/58
5,754,842 A 5/1998 Minagawa
5,755,948 A 5/1998 Lazaro et al.
5,759,006 A 6/1998 Miyamoto et al.
5,762,708 A 6/1998 Motoda
5,762,751 A 6/1998 Bleck
5,765,444 A 6/1998 Bacchi
5,765,889 A 6/1998 Nam et al.
5,776,327 A 7/1998 Botts et al. ..... 205/96
5,779,796 A 7/1998 Tomoeda
5,785,826 A 7/1998 Greenspan
5,788,829 A 8/1998 Joshi et al. ..... 205/96
5,802,856 A 9/1998 Schaper et al. ..... 62/3
5,815,762 A 9/1998 Sakai
5,829,791 A 11/1998 Kotsubo et al. ..... 285/26
5,843,296 A 12/1998 Greenspan ..... 205/68
5,845,662 A 12/1998 Sumnitsch
5,860,640 A 1/1999 Marohl
5,868,866 A 2/1999 Maekawa
5,871,626 A 2/1999 Crafts
5,871,805 A 2/1999 Lemelson
5,872,633 A 2/1999 Holzapfel
5,882,433 A 3/1999 Ueno
5,882,498 A 3/1999 Dubin
5,883,762 A * 3/1999 Calhoun et al. ..... 205/119
5,885,755 A 3/1999 Nakagawa
5,892,207 A 4/1999 Kawamura et al. ..... 219/492
5,900,663 A 5/1999 Johnson
5,904,827 A 5/1999 Reynolds ..... 205/68
5,908,543 A 6/1999 Matsunami
5,916,366 A 6/1999 Ueyama
5,924,058 A 7/1999 Waldhauer
5,925,227 A 7/1999 Kobayashi et al.
5,932,077 A 8/1999 Reynolds ..... 204/224
5,937,142 A 8/1999 Moslehi et al. ..... 392/416
5,942,035 A 8/1999 Hasebe
5,948,203 A 9/1999 Wang
5,952,050 A 9/1999 Doan
5,957,836 A 9/1999 Johnson ..... 600/235
5,964,643 A 10/1999 Birang
5,980,706 A 11/1999 Bleck et al.
5,985,126 A 11/1999 Bleck et al.
5,989,397 A 11/1999 Laube
5,989,406 A 11/1999 Beetz
5,997,653 A 12/1999 Yamasaka
5,998,123 A 12/1999 Tanaka et al. ..... 430/555
5,999,886 A 12/1999 Martin
6,001,235 A 12/1999 Arken et al. ..... 205/137
6,004,047 A 12/1999 Akimoto
6,004,828 A 12/1999 Hanson
6,017,437 A 1/2000 Ting
6,017,820 A * 1/2000 Ting et al. ..... 438/689
6,025,600 A 2/2000 Archie
6,027,631 A 2/2000 Broadbent
6,028,986 A 2/2000 Song
6,045,618 A 4/2000 Raoux
6,051,284 A 4/2000 Byrne et al.
6,053,687 A 4/2000 Kirkpatrick
6,063,190 A 5/2000 Hasebe et al.
6,072,160 A 6/2000 Bahl ..... 219/405
6,072,163 A 6/2000 Armstrong et al. ..... 219/497
6,074,544 A 6/2000 Reid
6,077,412 A 6/2000 Ting
6,080,288 A 6/2000 Schwartz et al.
6,080,291 A 6/2000 Woodruff et al. ..... 204/297
6,080,691 A 6/2000 Lindsay et al. ..... 442/381
6,086,680 A 7/2000 Foster et al. ..... 118/725
6,090,260 A 7/2000 Inoue
6,091,498 A 7/2000 Hanson
6,099,702 A 8/2000 Reid et al.
6,099,712 A 8/2000 Ritzdorf
6,103,085 A 8/2000 Woo et al.
6,107,192 A 8/2000 Subrahmanyan et al. ... 438/637
6,108,937 A 8/2000 Raaijmakers ..... 34/433
6,110,011 A 8/2000 Somekh
6,110,346 A 8/2000 Reid
6,122,046 A 9/2000 Almogy
6,130,415 A 10/2000 Knoot ..... 219/502
6,132,289 A 10/2000 Labunsky
6,136,163 A 10/2000 Cheung et al. ..... 204/198
6,139,703 A 10/2000 Hanson et al. ..... 204/212
6,139,712 A 10/2000 Patton et al. ..... 205/143
6,140,234 A 10/2000 Uzoh et al.
6,143,147 A 11/2000 Jelinek ..... 204/298
6,143,155 A 11/2000 Adams et al.
6,149,729 A 11/2000 Iwata
6,151,532 A 11/2000 Barone

| | | | | |
|---|---|---|---|---|
| 6,156,167 | A | 12/2000 | Patton et al. | 204/270 |
| 6,157,106 | A | 12/2000 | Tietz et al. | 310/90 |
| 6,159,073 | A | 12/2000 | Wiswesser | |
| 6,159,354 | A | 12/2000 | Contolini et al. | |
| 6,162,344 | A | 12/2000 | Reid | |
| 6,162,488 | A | 12/2000 | Gevelber et al. | |
| 6,168,693 | B1 | 1/2001 | Uzoh | |
| 6,168,695 | B1 | 1/2001 | Woodruff | |
| 6,174,425 | B1 | 1/2001 | Simpson | |
| 6,174,796 | B1 | 1/2001 | Takagi et al. | |
| 6,179,983 | B1 | 1/2001 | Reid et al. | |
| 6,184,068 | B1 | 2/2001 | Ohtani et al. | 438/151 |
| 6,187,072 | B1 | 2/2001 | Cheung | |
| 6,190,234 | B1 | 2/2001 | Swedek | |
| 6,193,802 | B1 | 2/2001 | Pang | |
| 6,193,859 | B1 | 2/2001 | Contolini et al. | |
| 6,194,628 | B1 | 2/2001 | Pang | |
| 6,197,181 | B1 | 3/2001 | Chen | |
| 6,199,301 | B1 | 3/2001 | Wallace | |
| 6,201,240 | B1 | 3/2001 | Dotan | |
| 6,208,751 | B1 | 3/2001 | Almogy | |
| 6,218,097 | B1 | 4/2001 | Bell et al. | 430/544 |
| 6,221,230 | B1 | 4/2001 | Takeuchi et al. | |
| 6,228,232 | B1 | 5/2001 | Woodruff et al. | 204/242 |
| 6,231,743 | B1 | 5/2001 | Etherington | |
| 6,234,738 | B1 | 5/2001 | Kimata | |
| 6,238,539 | B1 | 5/2001 | Joyce | |
| 6,244,931 | B1 | 6/2001 | Pinson | |
| 6,247,998 | B1 | 6/2001 | Wiswesser | |
| 6,251,238 | B1 | 6/2001 | Kaufman et al. | |
| 6,251,528 | B1 | 6/2001 | Uzoh et al. | |
| 6,251,692 | B1 | 6/2001 | Hanson | |
| 6,254,742 | B1 | 7/2001 | Hanson et al. | |
| 6,255,222 | B1 | 7/2001 | Xia | |
| 6,258,220 | B1 | 7/2001 | Dordi | |
| 6,261,433 | B1 | 7/2001 | Landau | |
| 6,264,752 | B1 | 7/2001 | Curtis | |
| 6,268,289 | B1 | 7/2001 | Chowdhury | |
| 6,270,619 | B1 | 8/2001 | Suzuki | |
| 6,270,634 | B1 | 8/2001 | Khan | |
| 6,270,647 | B1 | 8/2001 | Graham | |
| 6,277,194 | B1 | 8/2001 | Thilderkvist | |
| 6,277,263 | B1 | 8/2001 | Chen | |
| 6,278,089 | B1 | 8/2001 | Young et al. | 219/443 |
| 6,280,183 | B1 | 8/2001 | Mayur et al. | 432/258 |
| 6,280,582 | B1 | 8/2001 | Woodruff et al. | |
| 6,280,583 | B1 | 8/2001 | Woodruff et al. | |
| 6,290,865 | B1 | 9/2001 | Lloyd | |
| 6,297,154 | B1 | 10/2001 | Gross et al. | 438/663 |
| 6,303,010 | B1 | 10/2001 | Woodruff et al. | 204/297 |
| 6,309,520 | B1 | 10/2001 | Woodruff et al. | 204/242 |
| 6,309,524 | B1 | 10/2001 | Woodruff et al. | 204/297 |
| 6,309,981 | B1 | 10/2001 | Mayer | |
| 6,309,984 | B1 | 10/2001 | Nonaka | |
| 6,318,385 | B1 | 11/2001 | Curtis | |
| 6,318,951 | B1 | 11/2001 | Schmidt | |
| 6,322,112 | B1 | 11/2001 | Duncan | |
| 6,322,677 | B1 | 11/2001 | Woodruff | |
| 6,333,275 | B1 | 12/2001 | Mayer | |
| 6,342,137 | B1 | 1/2002 | Woodruff | |
| 6,350,319 | B1 | 2/2002 | Curtiss | |
| 6,365,729 | B1 | 4/2002 | Tyagi et al. | |
| 6,391,166 | B1 | 5/2002 | Wang | |
| 6,399,505 | B1 | 6/2002 | Nogami | |
| 6,402,923 | B1 | 6/2002 | Mayer | |
| 6,409,892 | B1 | 6/2002 | Woodruff et al. | |
| 6,413,390 | B1 * | 7/2002 | Tran | 204/237 |
| 6,413,436 | B1 | 7/2002 | Aegerter | |
| 6,423,642 | B1 | 7/2002 | Peace | |
| 6,428,660 | B1 | 8/2002 | Woodruff et al. | |
| 6,428,662 | B1 | 8/2002 | Woodruff et al. | |
| 6,444,101 | B1 | 9/2002 | Stevens et al. | |
| 6,471,913 | B1 | 10/2002 | Weaver et al. | 266/256 |
| 6,481,956 | B1 | 11/2002 | Hofmeister | |
| 6,491,806 | B1 | 12/2002 | Dubin | |
| 6,494,221 | B1 | 12/2002 | Sellmer | |
| 6,497,801 | B1 | 12/2002 | Woodruff | |
| 6,527,920 | B1 * | 3/2003 | Mayer et al. | 204/237 |
| 6,562,421 | B1 | 5/2003 | Sudo et al. | |
| 6,565,729 | B1 | 5/2003 | Chen et al. | |
| 6,569,297 | B1 | 5/2003 | Wilson et al. | |
| 6,599,412 | B1 | 7/2003 | Graham | |
| 6,623,609 | B1 | 9/2003 | Harris et al. | |
| 6,632,334 | B1 | 10/2003 | Anderson et al. | |
| 6,654,122 | B1 | 11/2003 | Hanson | |
| 6,660,137 | B1 | 12/2003 | Wilson et al. | |
| 6,672,820 | B1 | 1/2004 | Hanson | |
| 6,678,055 | B1 | 1/2004 | Du-Nour et al. | |
| 6,699,373 | B1 | 3/2004 | Woodruff et al. | |
| 6,709,562 | B1 | 3/2004 | Andricacos et al. | |
| 6,747,754 | B1 | 6/2004 | Iyoki | |
| 6,755,954 | B1 | 6/2004 | Mayer et al. | |
| 6,773,018 | B1 | 8/2004 | Gomez | |
| 6,773,571 | B1 | 8/2004 | Mayer et al. | |
| 2001/0024611 | A1 | 9/2001 | Woodruff | |
| 2001/0032788 | A1 | 10/2001 | Woodruff | |
| 2001/0043856 | A1 | 11/2001 | Woodruff | |
| 2002/0008036 | A1 | 1/2002 | Wang | |
| 2002/0008037 | A1 | 1/2002 | Wilson | |
| 2002/0022363 | A1 | 2/2002 | Ritzdorf et al. | |
| 2002/0032499 | A1 | 3/2002 | Wilson | |
| 2002/0046952 | A1 | 4/2002 | Graham | |
| 2002/0079215 | A1 | 6/2002 | Wilson et al. | 204/275 |
| 2002/0096508 | A1 | 7/2002 | Weaver et al. | 219/444 |
| 2002/0125141 | A1 | 9/2002 | Wilson | |
| 2002/0139678 | A1 | 10/2002 | Wilson | |
| 2003/0020928 | A1 | 1/2003 | Ritzdorf | |
| 2003/0038035 | A1 | 2/2003 | Wilson | |
| 2003/0062258 | A1 | 4/2003 | Woodruff | |
| 2003/0066752 | A1 | 4/2003 | Ritzdorf | |
| 2003/0070918 | A1 | 4/2003 | Hanson | |
| 2003/0127337 | A1 | 7/2003 | Hanson | |
| 2004/0031693 | A1 | 2/2004 | Chen | |
| 2004/0055877 | A1 | 3/2004 | Wilson | |
| 2004/0099533 | A1 | 5/2004 | Wilson | |

FOREIGN PATENT DOCUMENTS

| | | | | |
|---|---|---|---|---|
| DE | 41 14 427 | | | 11/1992 |
| DE | 4202194 | | | 7/1993 |
| DE | 195 25 666 | | | 10/1996 |
| EP | 0 140 404 | A1 | | 8/1984 |
| EP | 0047132 | B1 | | 7/1985 |
| EP | 0 257 670 | | | 3/1988 |
| EP | 0 290 210 | | | 11/1988 |
| EP | 0290210 | | | 11/1988 |
| EP | 0 677 612 | A2 | | 10/1995 |
| EP | 0 677 612 | A3 | | 10/1995 |
| EP | 0582019 | B1 | | 10/1995 |
| EP | 0544311 | B1 | | 5/1996 |
| EP | 0 881 673 | A2 | | 5/1998 |
| EP | 0 924 754 | A2 | | 10/1998 |
| EP | 0 982 771 | A1 | | 8/1999 |
| EP | 1 037 261 | A2 | | 3/2000 |
| EP | 1 069 213 | A2 | | 7/2000 |
| EP | 0452939 | B1 | | 11/2000 |
| EP | 105174 | | | 12/2000 |
| GB | 2217107 | A | | 3/1989 |
| GB | 2 254 288 | A | | 3/1992 |
| GB | 4109955 | | | 10/1992 |
| GB | 2 279 372 | A | | 6/1994 |
| JP | 52-12576 | | | 1/1977 |
| JP | 59-150094 | A | * | 8/1984 |
| JP | 59-208831 | | | 11/1984 |
| JP | 60-137016 | | | 7/1985 |
| JP | 61-196534 | | | 8/1986 |

| | | | |
|---|---|---|---|
| JP | 62-166515 | | 7/1987 |
| JP | 63-185029 | | 7/1988 |
| JP | 1048442 | | 2/1989 |
| JP | 1-120023 | | 5/1989 |
| JP | 1-283845 | | 11/1989 |
| JP | 4-94537 | | 3/1992 |
| JP | 4144150 | | 5/1992 |
| JP | 4311591 | | 11/1992 |
| JP | 5-13322 | | 1/1993 |
| JP | 5-21332 | | 1/1993 |
| JP | 5146984 | | 6/1993 |
| JP | 5195183 | A | 8/1993 |
| JP | 5211224 | | 8/1993 |
| JP | 5-326483 | | 12/1993 |
| JP | 6017291 | A | 1/1994 |
| JP | 6-45302 | | 2/1994 |
| JP | 6073598 | A | 3/1994 |
| JP | 6224202 | A | 8/1994 |
| JP | 7113159 | A | 5/1995 |
| JP | 7197299 | A | 8/1995 |
| JP | 8-279494 | | 11/1995 |
| JP | 9-181026 | | 7/1997 |
| JP | 10-083960 | | 3/1998 |
| JP | 11036096 | A | 2/1999 |
| JP | 11080993 | A | 3/1999 |
| WO | WO-90/00476 | | 1/1990 |
| WO | WO 91/04213 | | 4/1991 |
| WO | WO-95/06326 | | 3/1995 |
| WO | WO-95/20064 | | 7/1995 |
| WO | WO-99/16936 | | 4/1996 |
| WO | WO 99/16936 | | 4/1996 |
| WO | WO 99/25904 | | 5/1999 |
| WO | WO 99/25905 | | 5/1999 |
| WO | WO 99/40615 | | 8/1999 |
| WO | WO-99/41434 | | 8/1999 |
| WO | WO 99/45745 | | 9/1999 |
| WO | WO-00/02675 | | 1/2000 |
| WO | WO-00/02808 | | 1/2000 |
| WO | WO-00/02808 | A1 | 1/2000 |
| WO | WO 00/03072 | | 1/2000 |
| WO | WO-02/02808 | | 1/2000 |
| WO | WO 00/32835 | | 6/2000 |
| WO | WO-00/61498 | | 10/2000 |
| WO | WO 00/61837 | | 10/2000 |
| WO | WO-01/46910 | | 6/2001 |
| WO | WO-01/90434 | | 11/2001 |
| WO | WO-01/91163 | | 11/2001 |
| WO | WO-02/04886 | | 1/2002 |
| WO | WO-02/04887 | | 1/2002 |
| WO | WO-02/17203 | | 2/2002 |
| WO | WO-02/045476 | | 6/2002 |
| WO | WO-03/18874 | | 9/2002 |
| WO | WO-02/097165 | | 12/2002 |
| WO | WO-02/97165 | | 12/2002 |
| WO | WO-02/099165 | | 12/2002 |
| WO | WO-02/99165 | | 12/2002 |

OTHER PUBLICATIONS

Patnet Abstract of Japan, English Abstract Translation—Japanese Utility Model No. 2538705, Publication Date: Aug. 25, 1992.

U.S. Appl. No. 60/129,055, McHugh.

Contolini et al., "Copper Electroplating Process for Sub-Half-Micron ULSI Structures," VMIC Conference 1995 ISMIC—04/95/0322, pp. 322-328, Jun. 17-29, 1995.

Devaraj et al., "Pulsed Electrodeposition of Copper," Plating & Surface Finishing, pp. 72-78, Aug. 1992.

Dubin, "Copper Plating Techniques for ULSI Metallization," Advanced MicroDevices, no date.

Dubin, V.M., " Electrochemical Deposition of Copper for On-Chip Interconnects," Advanced MicroDevices, no date.

Gauvin et al., "The Effect of Chloride Ions on Copper Deposition," J. of Electrochemical Society, vol. 99, pp. 71-75, Feb. 1952.

International Search Report for PCT/US02/17840; Applicant: Semitool, Inc., Mar. 3, 2003, 4 pgs.

International Search Report PCT/US02/17203; Semitool, Inc., Dec. 31, 2002, 4 pgs.

Lee, Tien-Yu Tom et al., "Application of a CFD Tool in Designing a Fountain Plating Cell for Uniform Bump Plating of Semiconductor Wafers," IEEE Transactions On Components, Packaging and Manufacturing Technology—Part B, Feb. 1996, pp. 131-137, vol. 19, No. 1, IEEE.

Lowenheim, Frederick A., "Electroplating Electrochemistry Applied to Electroplating," 1978, pp. 152-155, McGraw-Hill Book Company, New York, no month.

Ossro, N.M., "An Overview of Pulse Plating," Plating and Surface Finishing, Mar. 1986.

Passal, F., "Copper Plating During the Last Fifty Years," Plating, pp. 628-638, Jun. 1959.

Patent Abstract of Japan, "Partial Plating Device," Publciation No. 01234590, Publication Date: Sep. 19, 1989.

Patent Abstract of Japan, "Plating Method" Publication No. 57171690, Publication Date: Oct. 22, 1982.

Ritter, G., et al., "Two-And Three-Dimensional Numerical Modeling of Copper Electroplating for Advanced ULSI Metallization," Jun. 1999, 13 pgs, E-MRS Conference Symposium M. Basic Models to Enhance Reliability, Strasbourg, France.

Singer, P., "Copper Goes Mainstream: Low k to Follow," Semiconductor International, pp. 67-70, Nov. 1997.

PCT International Search Report; Applicant: Semitool, Inc., International App No. PCT/US02/28071; Dec. 13, 2002, 4 pgs.

U.S. Appl. No. 08/940,524, filed Sep. 30, 1997, Bleck et al.

U.S. Appl. No. 09/114,105, filed Jul. 11, 1998, Woodruff et al.

European Search Report for Application No. EP 02 78 0265; dated Apr. 28, 2005; Semitool, Inc. (2 pgs).

Lowenheim, Frederick A., "Electroplating," Jan. 1979, 12 pgs, McGraw-Hill Book Company, USA.

* cited by examiner

APPARATUS AND METHODS FOR ELECTROCHEMICAL PROCESSING OF MICROELECTRONIC WORKPIECES

CROSS-REFERENCE TO RELATED APPLICATIONS

The applications claims the benefit of U.S. application Ser. No. 60/316,597 filed on Aug. 31, 2001.

TECHNICAL FIELD

This application relates to reaction vessels and methods of making and using such vessels in electrochemical processing of microelectronic workpieces.

BACKGROUND

Microelectronic devices, such as semiconductor devices and field emission displays, are generally fabricated on and/or in microelectronic workpieces using several different types of machines ("tools"). Many such processing machines have a single processing station that performs one or more procedures on the workpieces. Other processing machines have a plurality of processing stations that perform a series of different procedures on individual workpieces or batches of workpieces. In a typical fabrication process, one or more layers of conductive materials are formed on the workpieces during deposition stages. The workpieces are then typically subject to etching and/or polishing procedures (i.e., planarization) to remove a portion of the deposited conductive layers for forming electrically isolated contacts and/or conductive lines.

Plating tools that plate metals or other materials on the workpieces are becoming an increasingly useful type of processing machine. Electroplating and electroless plating techniques can be used to deposit nickel, copper, solder, permalloy, gold, silver, platinum and other metals onto workpieces for forming blanket layers or patterned layers. A typical metal plating process involves depositing a seed layer onto the surface of the workpiece using chemical vapor deposition (CVD), physical vapor deposition (PVD), electroless plating processes, or other suitable methods. After forming the seed layer, a blanket layer or patterned layer of metal is plated onto the workpiece by applying an appropriate electrical potential between the seed layer and an electrode in the presence of an electroprocessing solution. The workpiece is then cleaned, etched and/or annealed in subsequent procedures before transferring the workpiece to another processing machine.

FIG. 1 illustrates an embodiment of a single-wafer processing station 1 that includes a container 2 for receiving a flow of electroplating solution from a fluid inlet 3 at a lower portion of the container 2. The processing station 1 can include an anode 4, a plate-type diffuser 6 having a plurality of apertures 7, and a workpiece holder 9 for carrying a workpiece 5. The workpiece holder 9 can include a plurality of electrical contacts for providing electrical current to a seed layer on the surface of the workpiece 5. The seed layer acts as a cathode when it is biased with a negative potential relative to the anode 4. The electroplating fluid flows around the anode 4, through the apertures 7 in the diffuser 6, and against the plating surface of the workpiece 5. The electroplating solution is an electrolyte that conducts electrical current between the anode 4 and the cathodic seed layer on the surface of the workpiece 5. Therefore, ions in the electroplating solution plate onto the surface of the workpiece 5.

The plating machines used in fabricating microelectronic devices must meet many specific performance criteria. For example, many processes must be able to form small contacts in vias that are less than 0.5 μm wide, and are desirably less than 0.1 μm wide. The plated metal layers accordingly often need to fill vias or trenches that are on the order of 0.1 μm wide, and the layer of plated material should also be deposited to a desired, uniform thickness across the surface of the workpiece 5.

One concern of many processing stations is that it is expensive to fabricate certain types of electrodes that are mounted in the reaction vessels. For example, nickel-sulfur (Ni—S) electrodes are used to deposit nickel on microelectronic workpieces. Plating nickel is particularly difficult because anodization of the nickel electrodes produces an oxide layer that reduces or at least alters the performance of the nickel plating process. To overcome anodization, nickel can be plated using a chlorine bath or an Ni—S electrode because both chlorine and sulfur counteract the anodizing process to provide a more consistent electrode performance. Ni—S electrodes are preferred over chlorine baths because the plated layer has a tensile stress when chlorine is used, but is stress-free or compressive when an Ni—S electrode is used. The stress-free or compressive layers are typically preferred over tensile layers to enhance annealing processes, CMP processes, and other post-plating procedures that are performed on the wafer.

Ni—S electrodes, however, are expensive to manufacture in solid, shaped configurations. Bulk Ni—S material that comes in the form of pellets (e.g., spheres or button-shaped pieces) cannot be molded into the desired shape because the sulfur vaporizes before the nickel melts. The solid, shaped Ni—S electrodes are accordingly formed using electrochemical techniques in which the bulk Ni—S material is dissolved into a bath and then re-plated onto a mandrel in the desired shape of the solid electrode. Although the bulk Ni—S material only costs approximately $4–$6 per pound, a finished solid, shaped Ni—S electrode can cost approximately $400–$600 per pound because of the electroforming process.

Another concern of several types of existing processing stations is that it is difficult and expensive to service the electrodes. Referring to FIG. 1, the anode 4 may need to be repaired or replaced periodically to maintain the necessary level of performance for the processing station. In many cases, an operator must move a head assembly out of the way to access the electrode(s) in the reaction vessel. It is not only time consuming to reposition the head assembly, but it is also typically awkward to access the electrodes even after the head assembly has been moved. Therefore, it is often difficult to service the electrodes in the reaction vessels.

SUMMARY

The present invention is directed toward processing chambers and tools that use processing chambers in electrochemical processing of microelectronic workpieces. Several embodiments of processing chambers in accordance with the invention provide electrodes that use a bulk material which is much less expensive than solid, shaped electrodes. For example, these embodiments are particularly useful in applications that use nickel-sulfur electrodes because bulk nickel-sulfur materials are much less expensive than solid, shaped nickel-sulfur electrodes that are manufactured using electroforming techniques. Several embodiments of processing chambers are also expected to significantly enhance the ability to service the electrodes by providing electrode assemblies that are not obstructed by the head assembly or other components in a reaction chamber where the workpiece is held during a processing cycle. Many of the embodiments of the invention are expected to provide these benefits while also meeting demanding performance specifications because several embodiments of the processing chambers have a virtual electrode unit that enhances the flexibility of the system to compensate for different performance criteria.

One embodiment of the invention is directed toward a processing chamber comprising a reaction vessel having an electro-reaction cell including a virtual electrode unit, an electrode assembly disposed relative to the electro-reaction cell to be in fluid communication with the virtual electrode unit, and an electrode in the electrode assembly. The virtual electrode unit has at least one opening defining at least one virtual electrode in the electro-reaction cell. The electrode assembly can include an electrode compartment and an interface element in the electrode compartment. The interface element can be a filter, a membrane, a basket, and/or another device configured to hold the electrode. The interface element, for example, can be a filter that surrounds a basket in which the electrode is positioned.

In a more particular embodiment, the electrode comprises a bulk electrode material, such as a plurality of pellets. The bulk electrode material can be contained in a basket, a filter, or a combination of a basket surrounded by a filter. In another embodiment, the electrode assembly comprises a remote electrode compartment that is outside of the electro-reaction cell so that a head assembly or the virtual electrode unit does not obstruct easy access to the electrode in the electrode compartment. In an alternate embodiment, the electrode assembly is positioned in the electro-reaction cell under the virtual electrode assembly, and the electrode is a bulk material electrode.

DETAILED DESCRIPTION

The following description discloses the details and features of several embodiments of electrochemical processing stations and integrated tools to process microelectronic workpieces. The term "microelectronic workpiece" is used throughout to include a workpiece formed from a substrate upon which and/or in which microelectronic circuits or components, data storage elements or layers, and/or micromechanical elements are fabricated. It will be appreciated that several of the details set forth below are provided to describe the following embodiments in a manner sufficient to enable a person skilled in the art to make and use the disclosed embodiments. Several of the details and advantages described below, however, may not be necessary to practice certain embodiments of the invention. Additionally, the invention can also include additional embodiments that are within the scope of the claims, but are not described in detail with respect to FIGS. 2–9.

The operation and features of electrochemical reaction vessels are best understood in light of the environment and equipment in which they can be used to electrochemically process workpieces (e.g., electroplate and/or electropolish). As such, embodiments of integrated tools with processing stations having the electrochemical processing station are initially described with reference to FIGS. 2 and 3. The details and features of several embodiments of electrochemical processing chambers are then described with reference to FIGS. 4–9.

Figure 1:
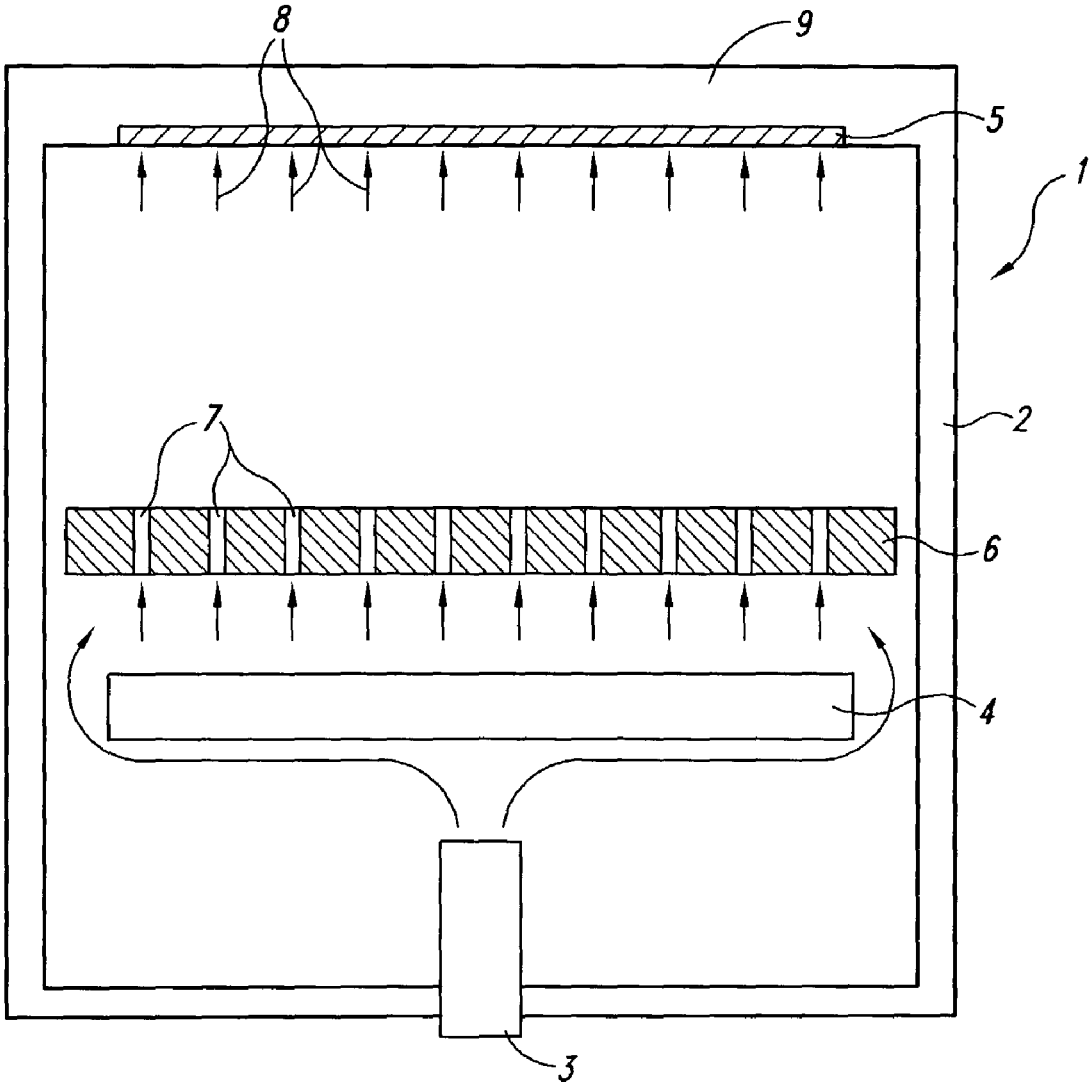
Fig. 1 (Prior Art)
FIG. 1 is a schematic diagram of an electroplating chamber in accordance with the prior art.
Figure 2:
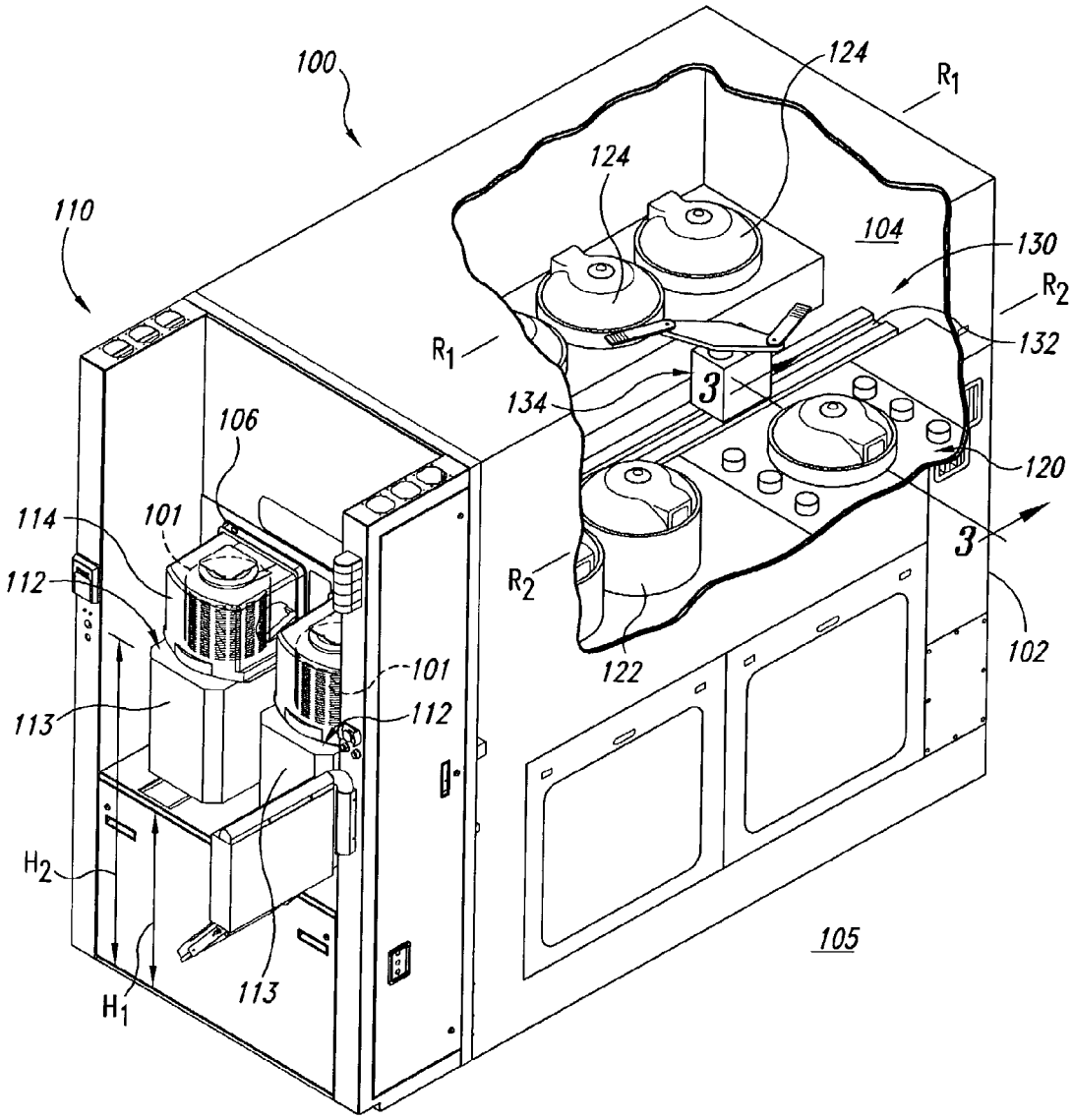
FIG. 2 is an isometric view of an electroprocessing machine having an electroprocessing station for processing microelectronic workpieces in accordance with an embodiment of the invention.

A. Selected Embodiments of Intergrated Tools with Electrochemical Processing Stations FIG. 2 is an isometric view of a processing machine 100 having an electrochemical processing station 120 in accordance with an embodiment of the invention. A portion of the processing machine 100 is shown in a cut-away view to illustrate selected internal components. In one aspect of this embodiment, the processing machine 100 can include a cabinet 102 having an interior region 104 defining an interior enclosure that is at least partially isolated from an exterior region 105. The cabinet 102 can also include a plurality of apertures 106 (only one shown in FIG. 1) through which microelectronic workpieces 101 can ingress and egress between the interior region 104 and a load/unload station 110.

The load/unload station 110 can have two container supports 112 that are each housed in a protective shroud 113. The container supports 112 are configured to position workpiece containers 114 relative to the apertures 106 in the cabinet 102. The workpiece containers 114 can each house a plurality of microelectronic workpieces 101 in a "mini" clean environment for carrying a plurality of workpieces through other environments that are not at clean room standards. Each of the workpiece containers 114 is accessible from the interior region 104 of the cabinet 102 through the apertures 106.

The processing machine 100 can also include a plurality of clean/etch capsules 122, other electrochemical processing stations 124, and a transfer device 130 in the interior region 104 of the cabinet 102. Additional embodiments of the processing machine 100 can include electroless plating stations, annealing stations, and/or metrology stations in addition to or in lieu of the clean/etch capsules 122 and other processing stations 124.

The transfer device 130 includes a linear track 132 extending in a lengthwise direction of the interior region 104 between the processing stations. The transfer device 130 can further include a robot unit 134 carried by the track 132. In the particular embodiment shown in FIG. 2, a first set of processing stations is arranged along a first row $R_1$—$R_1$ and a second set of processing stations is arranged along a second row $R_2$—$R_2$. The linear track 132 extends between the first and second rows of processing stations, and the robot unit 134 can access any of the processing stations along the track 132.

Figure 3:
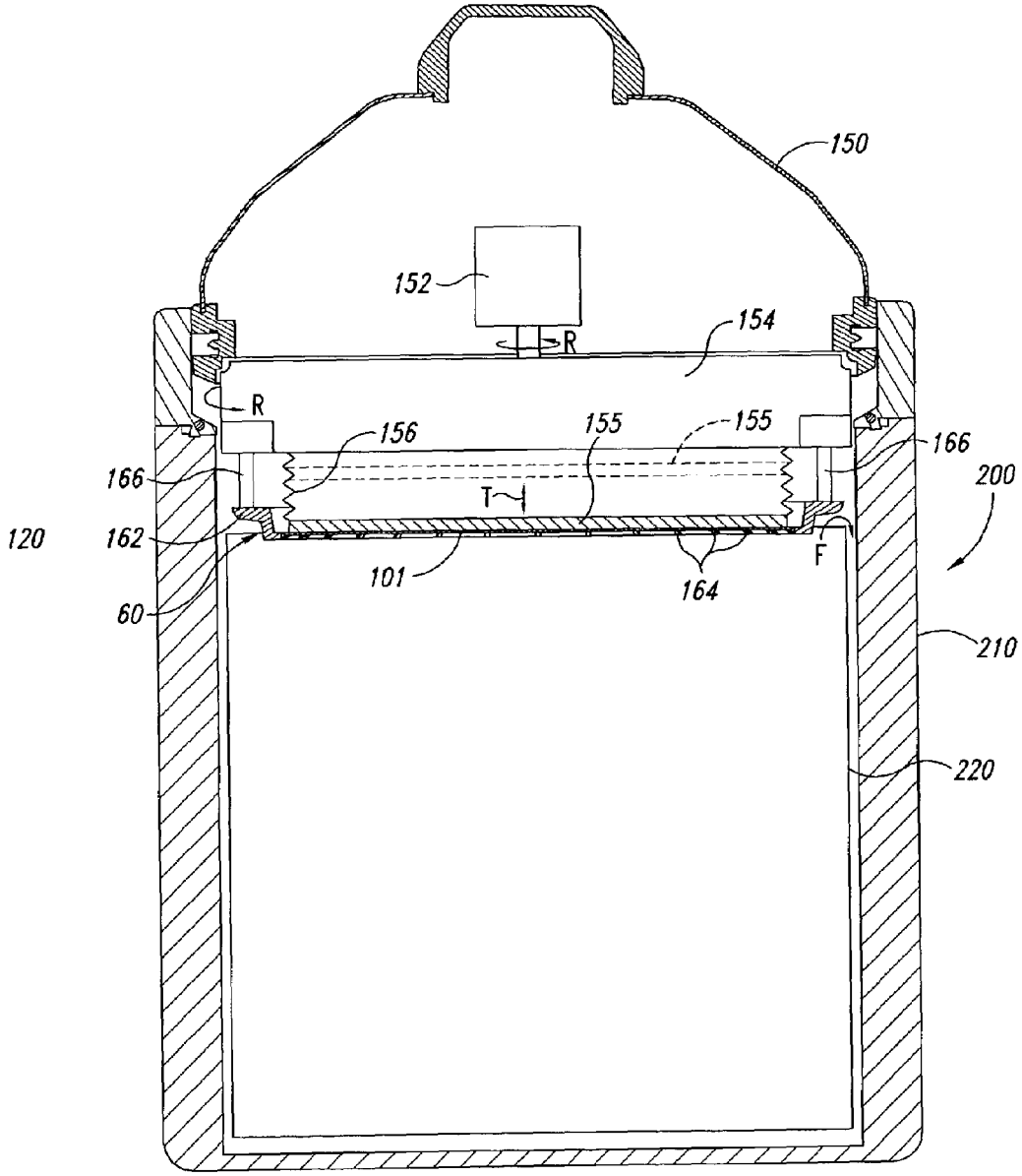
FIG. 3 is a cross-sectional view of an electroprocessing station having a head assembly and a processing chamber for use in an electroprocessing machine in accordance with an embodiment of the invention. Selected components in FIG. 3 are shown schematically.

FIG. 3 illustrates an embodiment of an electrochemical processing station 120 having a head assembly 150 and a processing chamber 200. The head assembly 150 includes a spin motor 152, a rotor 154 coupled to the spin motor 152, and a contact assembly 160 carried by the rotor 154. The rotor 154 can have a backing plate 155 and a seal 156. The backing plate 155 can move transverse to a workpiece 101 (arrow T) between a first position in which the backing plate 155 contacts a backside of the workpiece 101 (shown in solid lines in FIG. 3) and a second position in which it is spaced apart from the backside of the workpiece 101 (shown in broken lines in FIG. 3). The contact assembly 160 can have a support member 162, a plurality of contacts 164 carried by the support member 162, and a plurality of shafts 166 extending between the support member 162 and the rotor 154. The contacts 164 can be ring-type spring contacts or other types of contacts that are configured to engage a portion of the seed-layer on the workpiece 101. Commercially available head assemblies 150 and contact assemblies 160 can be used in the electroprocessing chamber 120. Suitable head assemblies 150 and contact assemblies 160 are disclosed in U.S. Pat. Nos. 6,228,232 and 6,080,691; and U.S. application Ser. Nos. 09/385,784; 09/386,803; 09/386,610; 09/386,197; 09/501,002; 09/733,608; and 09/804,696, all of which are herein incorporated by reference.

The processing chamber 200 includes an outer housing 210 (shown schematically in FIG. 3) and a reaction vessel 220 (also shown schematically in FIG. 3) in the housing 210. The reaction vessel 220 directs a flow of electroprocessing solution to the workpiece 101. The electroprocessing solution, for example, can flow over a weir (arrow F) and into the housing 210, from which the electroprocessing solution can be recycled. Several embodiments of processing chambers are shown and described in detail with reference to FIGS. 4–9.

The head assembly 150 holds the workpiece at a workpiece-processing site of the reaction vessel 220 so that at least a plating surface of the workpiece engages the electroprocessing solution. An electrical field is established in the solution by applying an electrical potential between the plating surface of the workpiece via the contact assembly 160 and one or more electrodes located at other parts of the processing chamber. For example, the contact assembly 160 can be biased with a negative potential with respect to the other electrode(s) to plate metals or other types of materials onto the workpiece. On the other hand, the contact assembly 160 can be biased with a positive potential with respect to the other electrode(s) to (a) de-plate or electropolish plated material from the workpiece or (b) deposit other materials onto the workpiece (e.g., electrophoretic resist). In general, therefore, materials can be deposited on or removed from the workpiece with the workpiece acting as a cathode or an anode depending upon the particular type of material used in the electrochemical process.

Figure 4:
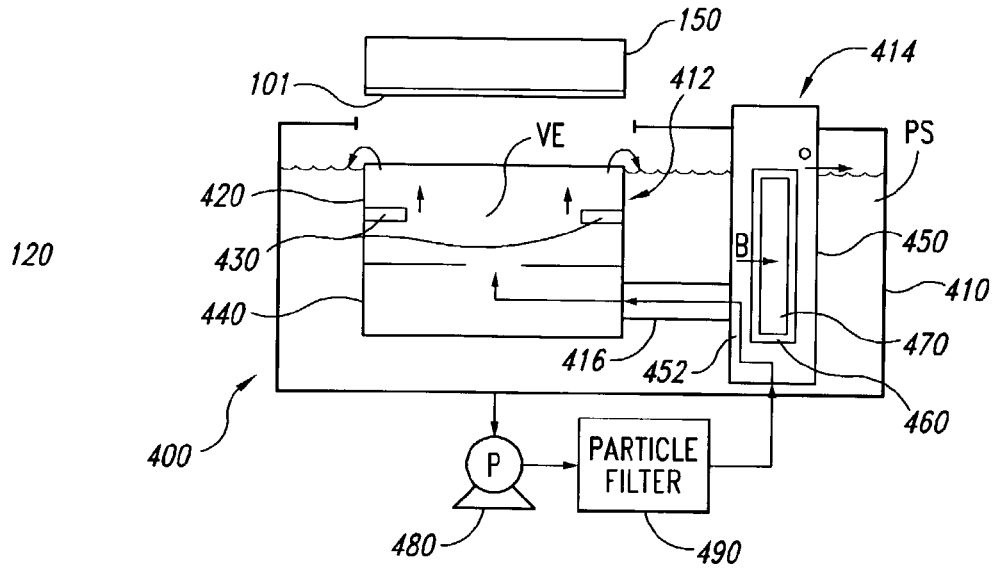
FIG. 4 is a schematic diagram of a processing station for use in an electroprocessing machine in accordance with an embodiment of the invention.

B. Selected Embodiments of Processing Chambers for Use in Electrochemical Processing Stations FIGS. 4–9 illustrate several embodiments of processing chambers in accordance with the invention. FIG. 4, more specifically, is a schematic diagram of an embodiment of a processing chamber 400 that can be used with the head assembly 150 in the processing station 120 in accordance with one embodiment of the invention. The processing chamber 400 can include a housing or tank 410, a reaction vessel 412 in the tank 410, and an electrode assembly 414 outside of the reaction vessel 412. The processing chamber 400 can also include a fluid passageway 416 through which a processing solution can flow to the reaction vessel 412 from the electrode assembly 414.

The reaction vessel 412 includes an electro-reaction cell 420 and a virtual electrode unit 430 in the electro-reaction cell 420. The virtual electrode unit 430 can be a dielectric element that shapes an electrical field within the electro-reaction cell 420. The virtual electrode unit 430, for example, has an opening that defines a virtual electrode VE. The virtual electrode VE performs as if an electrode is positioned at the opening of the virtual electrode unit 430 even though the physical location of the actual electrode is not aligned with opening in the virtual electrode unit 430. As described in more detail below, the actual electrode is positioned elsewhere in contact with an electrolytic processing solution that flows through the electro-reaction cell 420. The electro-reaction cell 420 can be mounted on a flow distributor 440 that guides the flow of processing solution from the fluid passageway 416 to the electro-reaction cell 420.

The electrode assembly 414 shown in the embodiment of FIG. 4 is a remote electrode assembly that is outside of or otherwise separate from the electro-reaction cell 420. The electrode assembly 414 can include an electrode compartment 450, an interface element 460 in the electrode compartment 450, and an electrode 470 disposed relative to the interface element 460. In an alternative embodiment, the interface element 460 is excluded such that the electrode 470 is exposed directly to the processing solution in the compartment 450. The electrode compartment 450 can be spaced apart from the electro-reaction cell 420 within the housing 410 (as shown in FIG. 4), or in an alternate embodiment (not shown) the electrode compartment 450 can be spaced outside of the housing 410. The electrode compartment 450 can extend above the housing 410 so that the electrode 470 can be easily serviced without having to move the head assembly 150. The remote location of the actual electrode 470 outside of the electro-reaction cell 420 solves the problem of accessing the actual electrode 470 for service or repair because the head assembly 150 does not obstruct the electrode assembly 414. This is expected to reduce the cost of operating the processing tool 100 (FIG. 2) because it will require less time to service/repair the electrodes, which will allow more time for the tool 100 to be available for processing workpieces.

The interface element 460 can inhibit particulates and bubbles generated by the electrode 470 from passing into the processing solution flowing through the fluid passageway 416 and into the electro-reaction cell 420. The interface element 460, however, allows electrons to pass from the electrode 470 and through the electrolytic processing solution PS in the processing chamber 400. The interface element 460 can be a filter, an ion membrane, or another type of material that selectively inhibits particulates and/or bubbles from passing out of the electrode assembly 414. The interface element 460, for example, can be cylindrical, rectilinear, two-dimensional or any other suitable shape that protects the processing solution PS from particles and/or bubbles that may be generated by the electrode 470.

The electrode 470 can be a bulk electrode or a solid electrode. When the electrode 470 is a nickel-sulfur electrode, it is advantageous to use a bulk electrode material within the interface element 460. By using bulk Ni—S electrode material, the processing station 120 does not need to have solid, shaped electrodes formed by expensive electroforming processes. The bulk Ni—S electrode is expected to be approximately two orders of magnitude less than a solid, shaped Ni—S electrode. Moreover, because the bulk electrode material is contained within the interface element 460, the pellets of the bulk electrode material are contained in a defined space that entraps particulates and bubbles. Another benefit of this embodiment is that the bulk electrode material not only reduces the cost of Ni—S electrodes, but it can also be easily replenished because the electrode assemblies 414 are outside of the electro-reaction cell 420. Thus, the combination of a remote electrode assembly, a bulk-material electrode, and a virtual electrode unit is expected to provide a chamber that performs as if the actual electrode is in the electro-reaction cell for precise processing without having expensive solid, shaped electrodes or the inconvenience of working around the head assembly.

The processing station 120 can plate or deplate metals, electrophoretic resist, or other materials onto a workpiece 101 carried by the head assembly 150. In operation, a pump 480 pumps the processing solution through a particle filter 490 and into the electrode compartment 450. In this embodiment, the processing solution PS flows through a channel 452 adjacent to the interface element 460, and then through the fluid passageway 416 and the flow distributor 440 until it reaches the electro-reaction cell 420. The processing solution PS continues to flow through the electro-reaction cell 420 until it crests over a weir, at which point it flows into the tank 410. The primary flow of the processing solution PS accordingly does not flow through the interface unit 460, but rather around it. A portion of the processing solution PS flowing through the electrode compartment 450 may "backflow" through the interface element 460 and across the electrode 470 (arrow B). The portion of the processing solution PS that backflows through the interface element 460 can exit through an outflow (arrow O) and return to the tank 410. The backflow portion of the processing solution PS that crosses over the electrode 470 replenishes ions from the electrode 470 to the bath of processing solution PS in the tank 410.

The electrons can flow from the electrode 470 to the workpiece 101, or in the opposite direction depending upon the particular electrical biasing between the workpiece 101 and the electrode 470. In the case of plating a metal onto the workpiece 101, the electrode 470 is an anode and the workpiece 101 is a cathode such that electrons flow from the electrode 470 to the workpiece 101. The electrons can accordingly flow through the interface element 460. It will be appreciated that the conductivity of the processing solution PS allows the electrons to move between the electrode 470 and the workpiece 101 according to the particular bias of the electrical field.

Figure 5A:
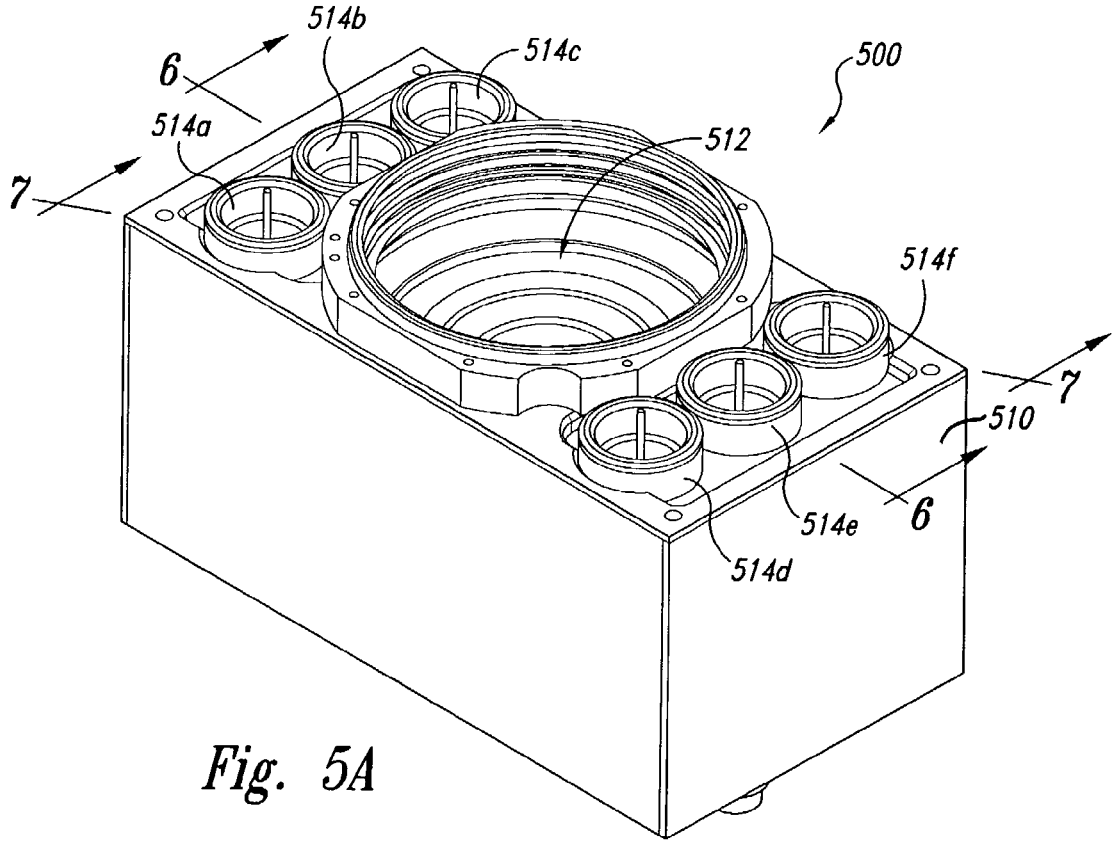
FIGS. 5A and 5B are isometric views showing portions of a processing chamber in accordance with an embodiment of the invention.
Figure 5B:
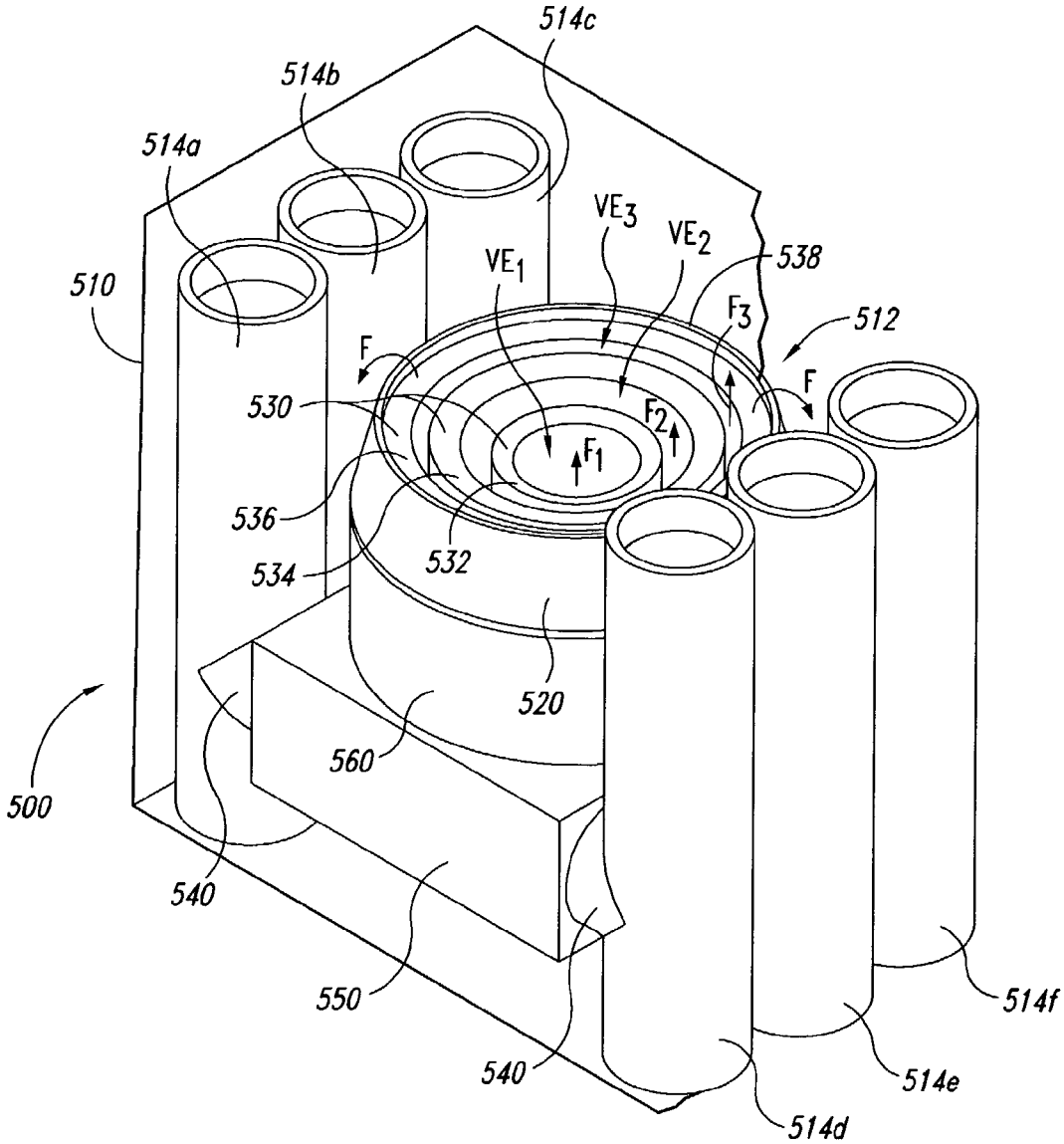

FIGS. 5A and 5B illustrate a processing chamber 500 that can be used in the processing station 120 in accordance with an embodiment of the invention. Referring to FIG. 5A, the processing chamber 500 includes a housing or tank 510, a reaction vessel 512 in the tank 510, and a plurality of electrode assemblies 514 outside of the reaction vessel 512. The electrode assemblies 514 are identified individually by reference numbers 514*a*–514*d*, but they are collectively referred to by reference number 514. The electrode assemblies 514 are separate from the reaction vessel 512 to provide easy access to the electrodes for the reasons explained above. In this embodiment, the electrode assemblies 514 have a lower portion in the tank 510 and an upper portion above or at least exposed at the top of the tank 510.

FIG. 5B is an isometric view that further illustrates several of the components of the processing chamber 500. The reaction vessel 512 includes a electro-reaction cell 520, and a virtual electrode unit 530 including a plurality of individual dielectric partitions that form openings defining virtual electrodes. In this embodiment, the virtual electrode unit 530 includes a first partition 532, a second partition 534 spaced apart from the first partition 532, and a third partition 536 spaced apart from the second partition 534. A first virtual electrode $VE_1$ is defined by the circular opening inside the first partition 532; a second virtual electrode $VE_2$ is defined by the annular opening between the first partition 532 and the second partition 534; and a third virtual electrode $VE_3$ is defined by the annular opening between the second partition 534 and the third partition 536. It will be appreciated that the partitions, and hence the virtual electrodes, can have other shapes, such as rectilinear or non-circular curvatures to define an electric field according to the particular parameters of the workpiece. The electro-reaction cell 520 also includes a weir 538 over which the processing solution PS can flow (arrow F) during processing.

The processing chamber 500 can further include a plurality of fluid passageways 540 and flow distributor 550 coupled to the fluid passageways 540. Each electrode assembly 514*a*–*f* is coupled to a corresponding fluid passageway 540 so that fluid flows from each electrode assembly 514 and into the flow distributor 550. The electro-reaction cell 520 can be coupled to the flow distributor 550 by a transition section 560. The flow distributor 550 and the transition section 560 can be configured so that the processing solution PS flows from particular electrode assemblies 514*a*–*f* to one of the virtual electrode openings $VE_1$–$VE_3$.

The particular flow path from the electrode assemblies 514 to the virtual electrode openings are selected to provide a desired electrical potential for each one of the virtual electrodes $VE_1$–$VE_3$ and mass transfer at the workpiece (e.g., the weir 538). In one particular embodiment, a first flow $F_1$ of processing solution through the first virtual electrode $VE_1$ opening comes from the electrode assemblies 514*b* and 514*e*; a second flow $F_2$ through the second virtual electrode opening $VE_2$ comes from the electrode assemblies 514*c* and 514*d*; and a third flow $F_3$ through the third virtual electrode $VE_3$ opening comes from the electrode assemblies 514*a* and 514*f*. The particular selection of which electrode assembly 514 services the flow through a particular virtual electrode opening depends upon several factors. As explained in more detail below, the particular flows are typically configured so that they provide a desired distribution of electrical current at each of the virtual electrode openings.

Figure 6:
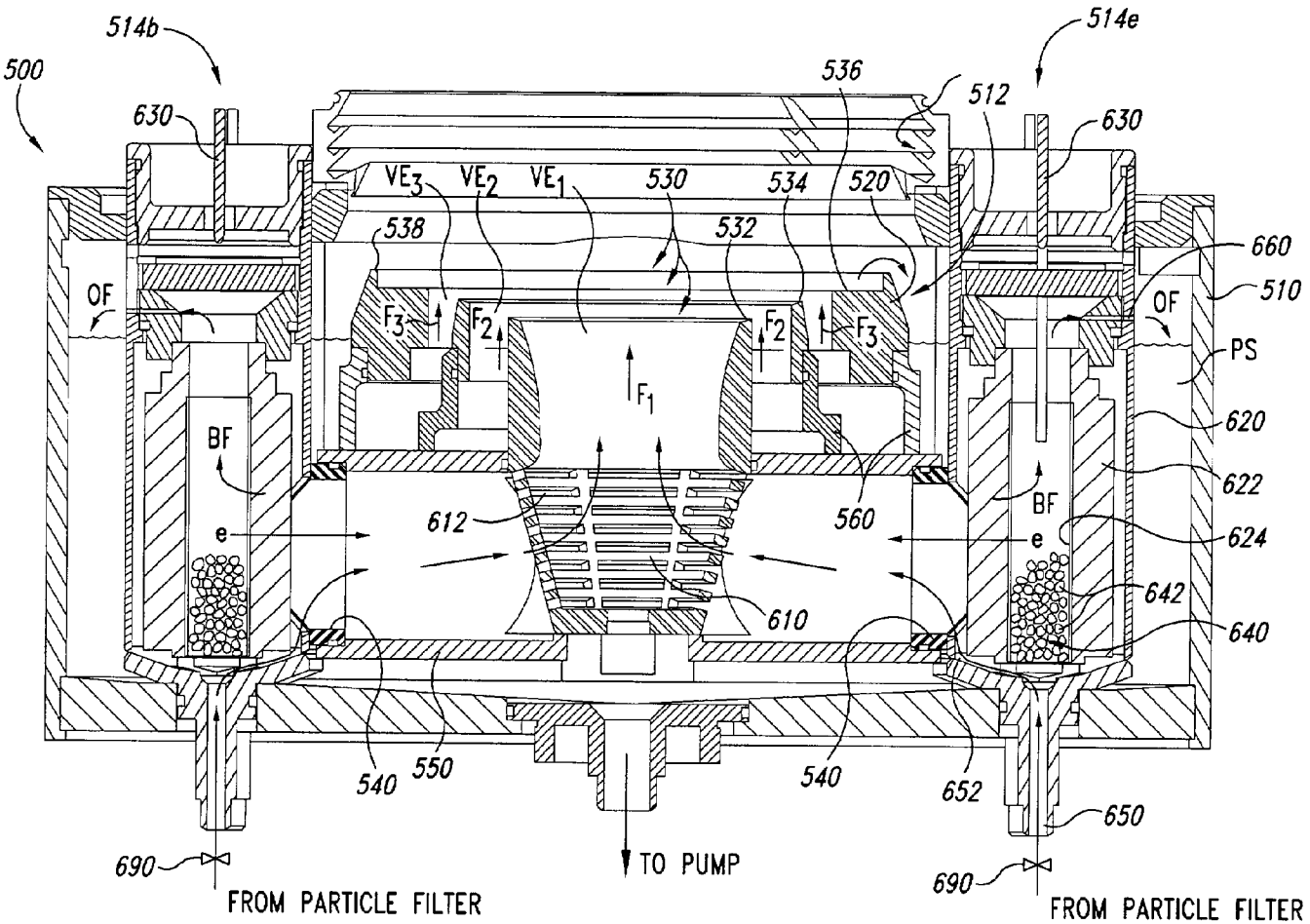
FIG. 6 is a cross-sectional view of an embodiment of the processing chamber shown in FIG. 5A taken along line 6—6.

FIG. 6 is a cross-sectional view of an embodiment of the processing chamber 500 shown in FIGS. 5A and 5B taken along line 6—6 (FIG. 5A). The electro-reaction cell 520 of the reaction vessel 512 can be defined by the partitions 532, 534 and 536 of the virtual electrode unit 530 and the transition section 560. In operation, the workpiece (not shown) is held proximate to the weir 538 so that the flow of processing solution over the weir 538 contacts at least one surface of the workpiece.

The reaction vessel 512 can also include a diffuser 610 projecting downward from the first partition 532. The diffuser 610 can have an inverted frusto-conical shape that tapers inwardly and downwardly within in a fluid passage of the flow distributor 550. The diffuser 610 can include a plurality of openings, such as circles or elongated slots, through which the processing solution can flow radially inwardly and then upwardly through the opening that defines the first virtual electrode $VE_1$. In this particular embodiment, the openings 612 are angled upwardly to project the flow from within the flow distributor 550 radially inwardly and slightly upward. It will be appreciated that the diffuser 610 can have other embodiments in which the flow is directed radially inwardly without an upward or downward component. Additionally, the diffuser 610 may also be eliminated from certain embodiments.

The electrode assemblies 514*b* and 514*e* can be similar or even identical to each other, and thus only the components of the electrode assembly 514*e* will be described. The electrode assembly 514*e* can include a casing or compartment 620, an interface element 622 inside the casing 620, and a basket 624 inside the interface element 622. As explained above, the interface element 622 can be a filter, an ion membrane, or another type of material that allows electrons to flow to or from the electrode assembly 514*e* via the processing solution. One suitable material for the interface element 622 is a filter composed of polypropylene, Teflon®, polyethersulfone, or other materials that are chemically compatible with the particular processing solution. In the embodiment shown in FIG. 6, the interface element 622 is a cylindrical member having a bore. The basket 624 can also be a cylindrical, electrically conductive member that fits within the bore of the interface element 622. The basket 624 is perforated with a plurality of holes (not shown in FIG. 6) or otherwise porous. In an alternate embodiment, the interface element 622 can be a basket without a filter.

The electrode assembly 514*e* can further include a lead 630 coupled to the basket 624 and an electrode 640 in the basket 624. In the embodiment shown in FIG. 6, the electrode 640 is a bulk electrode comprising a plurality of pellets 642, such a spheres or button-shaped members. The pellets 642 in FIG. 6 are formed from the desired material for the electrode. Several applications use a bulk electrode material that replenishes the processing solution with the desired ions for plating material onto the workpiece. It will be appreciated that the bulk electrode materials can be consumable or inert in the processing solution depending upon the particular application. In alternate embodiments, the electrode 640 can be a solid electrode instead of a bulk electrode material composed of a plurality of pellets.

In the embodiment shown in FIG. 6, the electrode assembly 514*e* has a fluid fitting 650 to receive a flow of filtered processing solution from the particle filter, and a gap 652 between the fitting 650 and the interface element 622. The gap 652 defines the primary fluid flow path through the electrode assembly 514*e*. In the embodiment shown in FIG. 6, the fluid flows in through the fitting 650, along the flow path 652 around the exterior of the interface element 622, and then through the fluid passageway 540 to reach the diffuser 610. A portion of the processing solution can back flow (arrow BF) through the interface element 622. The backflow portion of the processing solution can produce an outflow (arrow OF) that exits the electrode assembly 514*e* through an aperture 660. The outflow OF from the electrode assembly 514*e* can replenish ions for the processing solution PS in the tank 510. The processing solution is then recycled to the pump so that it can be filtered by the particle filter and then returned to the electrode assemblies 514. Electrons from the bulk electrode material 640 flow through the interface element 622 (arrow "e") via the processing solution PS. As a result, the electrical charge placed on the lead 514*e* can be controlled to adjust the current gradient in the electrical field at the rim of the first partition 532 that defines the first virtual electrode $VE_1$.

Figure 7:
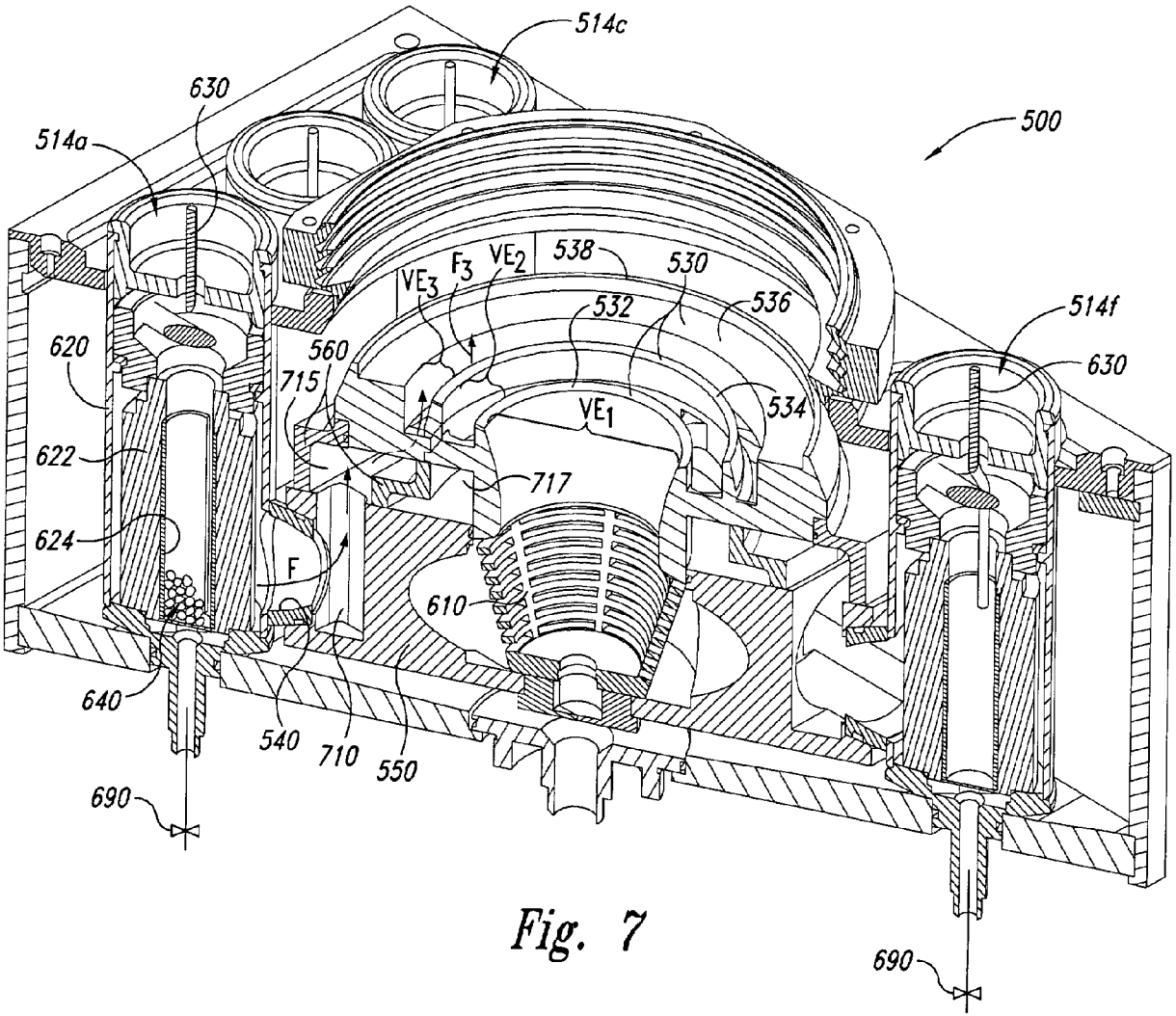
FIG. 7 is an isometric cross-sectional view showing another portion of the processing chamber of FIG. 5A taken along line 7—7.

FIG. 7 is an isometric, cross-sectional view of the processing chamber 500 illustrating a flow path of the processing solution through the third virtual electrode opening $VE_3$. It will appreciated that common numbers refer to like components in FIGS. 6 and 7. The cross-sectional portion in FIG. 7 shows the flow distributor 550 and the transition section 560 directing the flow F of processing solution PS through the fluid passageway 540 and into a channel 710 of the flow distributor 550. The channel 710 directs the fluid flow to an annular conduit 715 defined by the transition section 560. The third flow $F_3$ of the processing solution PS then flows upwardly through the annular opening defining the third virtual electrode $VE_3$. The flow distributor 550 and the transition section 560 operate in a similar manner to direct the fluid from the electrode assembly 514*f* to an opposing side of the annular conduit 715 defining the third virtual electrode $VE_3$. In this embodiment, the flow of processing solution going to the opening of the third virtual electrode $VE_3$ does not pass through the diffuser 610. It will be appreciated that the flow distributor 550 and the transition section 560 can operate in a similar manner to direct the flow of processing solution from the electrode assemblies 514*c* and 514*d* (shown in FIG. 5B) to an annular conduit 717 defined by the inner transition piece 560 and the first partition 532 of the virtual electrode unit 530. The flows from the electrode assemblies 514*c* and 514*d* accordingly enter at opposite sides of the annular conduit 717 and then flow upwardly through the annular opening between the first and second partitions 532 and 534 that define the second virtual electrode $VE_2$.

Referring to FIGS. 6 and 7 together, each of the electrode assemblies 514 can be coupled to the flow from the particle filter via a control valve 690, and each of the leads 630 can be coupled to an independently controlled electrical current. As such, the fluid flows $F_1$–$F_3$ through the virtual electrodes $VE_1$–$VE_3$ can be independently controlled, and the particular current at each of the virtual electrodes $VE_1$–$VE_3$ can also be independently controlled. In one embodiment, the first fluid flow $F_1$ has a much higher flow rate (volumetric and/or velocity) than the second and third fluid flows $F_2$ and $F_3$ such that the first fluid flow $F_1$ dominates the mass transfer and flow characteristics at the weir 538. The gradient of electrical current at the openings of the virtual electrodes $VE_1$–$VE_3$ can be controlled to provide a desired current distribution at the surface of the workpiece. Suitable programs and methods for controlling the individual electrical currents for each of the virtual electrodes $VE_1$–$VE_3$ are described in detail in PCT Publication Nos. WO00/61837 and WO00/61498; and U.S. application Ser. Nos. 09/849,505; 09/866,391; and 09/866,463.

The processing chamber 500 is expected to be cost efficient to manufacture and maintain, while also meeting stringent performance specifications that are often required for forming layers from metal or photoresist on semiconductor wafers or other types of microelectronic workpieces. One aspect of several embodiments of the processing chamber 500 is that bulk electrode materials can be used for the electrodes. This is particularly useful in the case of plating nickel because the cost of nickel-sulfur bulk electrode materials is significantly less than the cost of solid, shaped nickel-sulfur electrodes formed using electroforming processes. Additionally, by separating the electrode assemblies 514 from the electro-reaction cell 520, the head assembly or other components inside of the cell 520 do not need to be moved for electrode maintenance. This saves time and makes it easier to service the electrodes. As a result, more time is available for the processing chamber 500 to be used for plating workpieces. Moreover, several embodiments of the processing chamber 500 achieve these benefits while also meeting demanding performance specifications. This is possible because the virtual anode unit 530 shapes the electrical field proximate to the workpiece in a manner that allows the remote electrodes in the electrode assemblies 514 to perform as if they are located in the openings of the virtual electrode unit 530. Therefore, several embodiments of the processing chamber 500 provide for cost effective operation of a planarizing tool while maintaining the desired level of performance.

Another feature of several embodiments of the processing chamber 500 is that commercially available types of filters can be used for the interface element. This is expected to help reduce the cost of manufacturing the processing chamber. It will be appreciated, however, that custom filters or membranes can be used, or that no filters may be used.

Another aspect of selected embodiments of the processing chamber 500 is that the tank 510 houses the reaction vessel 512 in a manner that eliminates return plumbing. This frees up space within the lower cabinet for pumps, filters and other components so that more features can be added to a tool or more room can be available for easier maintenance of components in the cabinet. Additionally, in the case of electroless processing, a heating element can be placed directly in the tank 510 to provide enhanced accuracy because the proximity of the heating element to the reaction vessel 512 will produce a smaller temperature gradient between the fluid at the heating element and the fluid at the workpiece site. This is expected to reduce the number of variables that can affect electroless plating processes.

Still another aspect of several embodiments of the processing chamber 500 is that the virtual electrode defined by the virtual electrode unit 530 can be readily manipulated to control the plating process more precisely. This provides a significant amount of flexibility to adjust the plating process for providing extremely low 3-σ results. Several aspects of different configurations of virtual electrode units and processing chambers are described in PCT Publication Nos. WO00/61837 and WO00/61498; and in U.S. application Ser. Nos. 09/849,505; 09/866,391; 09/866,463; 09/875,365; 09/872,151; all of which are herein incorporated by reference in their entirety.

Figure 8:
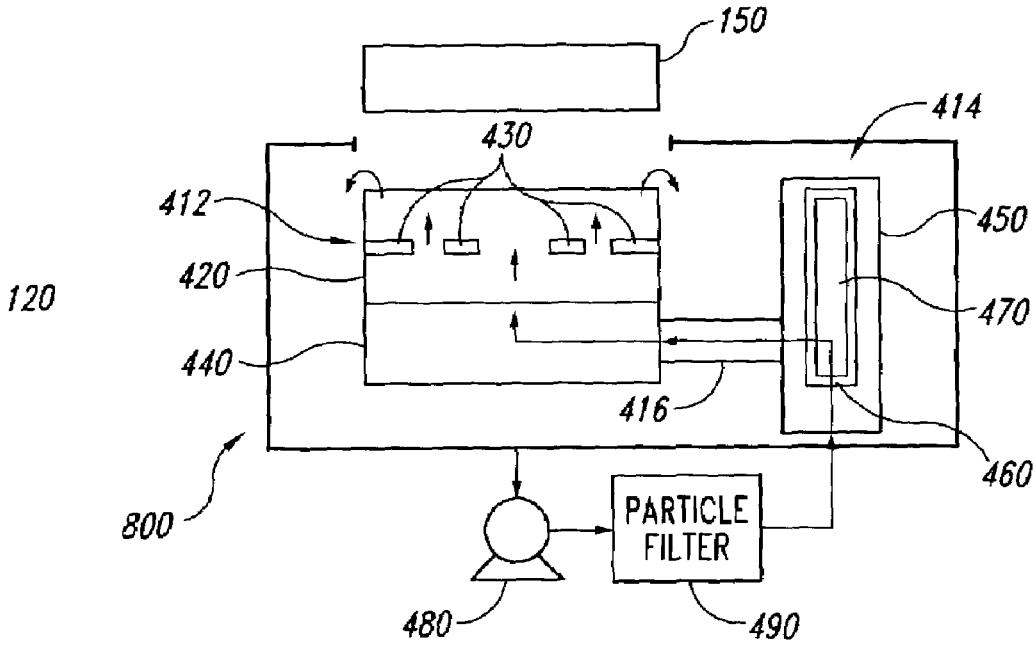
FIG. 8 is a schematic diagram of an electroprocessing station in accordance with another embodiment of the invention.

FIG. 8 is a schematic diagram of a processing chamber 800 for use in the processing station 120 in accordance with another embodiment of the invention. The processing chamber 800 is similar to the processing chamber 400 described above with reference to FIG. 4, and thus like references numbers refer to like components. The processing chamber 800 is different than the processing chamber 400 in that the processing solution in the processing chamber 800 flows from the particle filter 490 into the electrode compartment 450 and through the interface element 460 to flow past the electrode 470. The processing solution then flows out through the interface element 460 and to the reaction vessel 412 via the fluid passageway 416. The processing chamber 800 can accordingly be very similar to the processing chamber 500 described above with reference to FIGS. 5–7, but the processing solution in the processing chamber 800 would not necessarily flow through the gap 652 (FIG. 6) in the bottom of the electrode compartment 620, but rather it would flow directly up into the interface membrane 622. Accordingly, different embodiments of the invention can have different fluid flows around and/or through the interface element 622.

Figure 9:
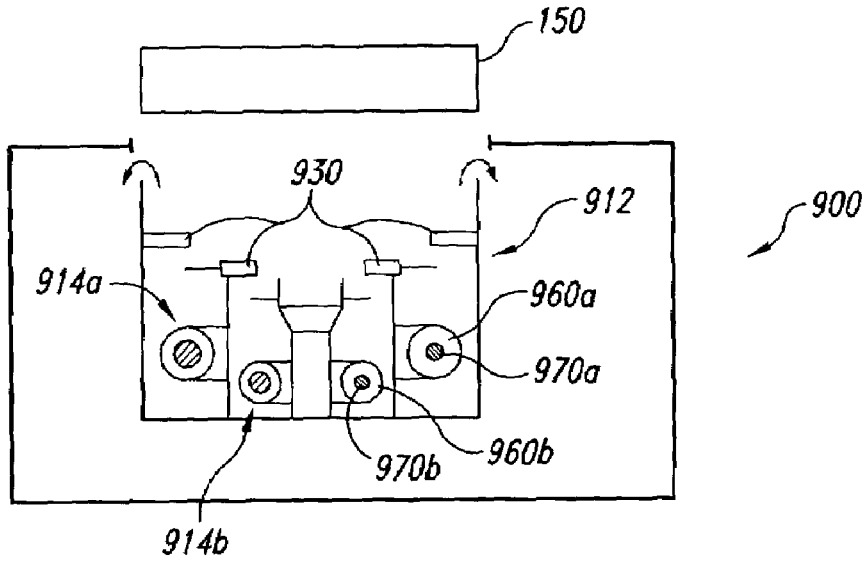
FIG. 9 is a schematic diagram of another embodiment of a processing station in accordance with yet another embodiment of the invention.

FIG. 9 is a schematic diagram illustrating a processing chamber 900 in accordance with another embodiment of the invention. In this embodiment, the processing chamber 900 includes a reaction vessel 912 that itself defines the electro-reaction cell and a virtual electrode unit 930 in the reaction vessel 912. The processing chamber 900 can further include at least one electrode assembly 914 having an interface element 960 and a bulk material electrode 970 in the interface element 960. The particular embodiment of the processing chamber 900 shown in FIG. 9 includes a plurality of electrode assemblies 914*a* and 914*b*. The first electrode assembly 914*a* includes a first interface element 960*a* defined by a toriodal tube and a bulk material electrode material 970*a* comprising a plurality of pellets inside the toriodal interface element 960*a*. The second electrode assembly 914*b* can be similar to the first electrode assembly 914*a*. The interface element 960 can be a filter or membrane without a basket, a basket without a filter or membrane, or a basket surrounded by a filter or membrane. The first electrode assembly 914*a* can be positioned in an outer section of the reaction vessel 912, and the second electrode assembly 914*b* can be positioned in an inner portion of the reaction vessel 912. The processing chamber 900 accordingly does not have separate remote electrodes that are outside of the reaction vessel 912, but it does include bulk material electrodes in combination with a virtual electrode reactor. It is expected that the processing chamber 900 will have some of the same benefits as those described above with reference to the processing chambers 400, 500 and 800, but it does not provide the easy access to the electrodes for maintenance or repair.

From the foregoing, it will be appreciated that specific embodiments of the invention have been described herein for purposes of illustration, but that various modifications may be made without deviating from the spirit and scope of the invention. Accordingly, the invention is not limited except as by the appended claims.

I claim:

1. A processing chamber for electrochemical processing of a microelectronic workpiece, comprising:

a reaction vessel including an electro-reaction cell configured to hold a processing solution and a virtual electrode unit in the electro-reaction cell, wherein the virtual electrode unit has an opening that defines a virtual electrode;

an electrode assembly disposed relative to the electro-reaction cell to be in fluid communication with the virtual electrode unit, the electrode assembly including an interface element; and an electrode in the electrode assembly, wherein the interface element is between the electrode and the virtual electrode unit, wherein the electrode assembly further comprises a plurality of remote electrode compartments separate from the electro-reaction cell including a first remote electrode compartment and a second remote electrode compartment;

the electro-reaction cell further comprises a plurality of virtual electrodes including a first virtual electrode and a second virtual electrode;

the processing chamber further comprises a flow control system having a first fluid passageway between the first remote electrode compartment and the first virtual electrode and a second fluid passageway between the second remote electrode compartment and the second virtual electrode; and the electrode comprises a first electrode in the first remote electrode compartment and the processing chamber further comprises a second electrode in the second remote electrode compartment.

2. A processing chamber for electrochemical processing of a microelectronic workpiece, comprising:

a reaction vessel including an electro-reaction cell configured to hold a processing solution at a processing site for immersing at least a portion of the workpiece in the processing solution and a virtual electrode unit in the electro-reaction cell, wherein the virtual electrode unit has an opening facing the processing site that defines a virtual electrode;

an electrode assembly having a remote electrode compartment outside of the electro-reaction cell and an interface member in the electrode compartment;

a fluid passageway between the electrode compartment and the electro-reaction cell; and a remote electrode in the electrode compartment, wherein the interface element is between the remote electrode and the virtual electrode unit, and wherein the electrode assembly further comprises a plurality of remote electrode compartments separate from the electro-reaction cell including a first remote electrode compartment and a second remote electrode compartment;

the electro-reaction cell further comprises a plurality of virtual electrodes including a first virtual electrode and a second virtual electrode;

the processing chamber further comprises a flow control system having a first fluid passageway between the first remote electrode compartment and the first virtual electrode and a second fluid passageway between the second remote electrode compartment and the second virtual electrode; and the electrode comprises a first electrode in the first remote electrode compartment and the processing chamber further comprises a second electrode in the second remote electrode compartment.

3. The processing chamber of claim 2 wherein the interface element comprises a basket and a filter in the basket, and the first electrode comprises a bulk electrode in the basket.

4. The processing chamber of claim 2 wherein the first remote electrode compartment comprises an outer wall spaced apart from the interface element that defines a primary flow path between the interface element and the outer wall for passing a primary flow of processing solution through the first remote electrode compartment outside of the interface element.

5. A processing chamber for electrochemical processing of a microelectronic workpiece, comprising:

a reaction vessel including an electro-reaction cell configured to hold a processing solution at a processing site for immersing at least a portion of the workpiece in the processing solution and a virtual electrode unit in the electro-reaction cell, wherein the virtual electrode unit has an opening facing the processing site that defines a virtual electrode for shaping an electrical field within the electro-reaction cell;

an electrode assembly having a remote electrode compartment separate from the electro-reaction cell to be in fluid communication with the virtual electrode unit, the electrode assembly further including an interface element in the electrode compartment;

a fluid passageway between the remote electrode compartment and the electro-reaction cell; and a remote electrode comprising a plurality of pellets in the interface element, wherein the remote electrode generates the electrical field that is shaped by the virtual electrode in the electro-reaction cell, and wherein the electrode assembly further comprises a plurality of remote electrode compartments separate from the electro-reaction cell including a first remote electrode compartment with a first interface element and a second remote electrode compartment with a second interface element;

the electro-reaction cell further comprises a plurality of virtual electrodes including a first virtual electrode and a second virtual electrode;

the processing chamber further comprises a flow control system having a first fluid passageway between the first remote electrode compartment and the first virtual electrode and a second fluid passageway between the second remote electrode compartment and the second virtual electrode; and the electrode comprises a first electrode in the first remote electrode compartment and the processing chamber further comprises a second electrode in the second remote electrode compartment.

6. The processing chamber of claim 5, further comprising a tank in which the electro-reaction cell and the electrode assembly are located, and wherein the first and second remote electrode compartments are separate from the electro-reaction cell and located in the tank.

7. The processing chamber of claim 5, further comprising:

a tank in which the electro-reaction cell and the first and second electrode compartments are located; and the first fluid passageway extends between the first remote electrode compartment and the electro-reaction cell.

8. The processing chamber of claim 5 wherein the electrode assembly further comprises a first basket in the first interface element in which the first electrode is located, a second basket in the second interface element in which the second electrode is located, and wherein the first and second electrodes comprise bulk electrodes.

9. The processing chamber of claim 5 wherein the first remote electrode compartment has an outer wall spaced apart from the first interface element that defines a first primary flow path between the first interface element and the outer wall for passing a primary flow of processing solution through the first remote electrode compartment outside of the interface element.

10. A reactor for processing microelectronic workpieces, comprising:

a processing head configured to hold a workpiece; and a processing chamber, the processing chamber comprising a reaction vessel including an electro-reaction cell configured to hold a processing solution and a virtual electrode unit including a virtual electrode in the electro-reaction cell, an electrode assembly including an interface element comprising an electrically conductive basket disposed relative to the electro-reaction cell to be in fluid communication the virtual electrode, and an electrode in the electrode assembly in the basket, wherein the electrode assembly further comprises a plurality of remote electrode compartments separate from the electro-reaction cell including a first remote electrode compartment with a first electrically conductive basket and a second remote electrode compartment with a second electrically conductive basket;

the electro-reaction cell further comprises a plurality of virtual electrodes including a first virtual electrode and a second virtual electrode;

the processing chamber further comprises a flow control system having a first fluid passageway between the first remote electrode compartment and the first virtual electrode and a second fluid passageway between the second remote electrode compartment and the second virtual electrode; and the electrode comprises a first electrode in the first remote electrode compartment and the processing chamber further comprises a second electrode in the second remote electrode compartment.

11. The reactor of claim 10 further comprising a tank in which the electro-reaction cell and the electrode assembly are located, and wherein the first and second remote electrode compartments are separate from the electro-reaction cell in the tank.

12. The reactor of claim 10 wherein the first electrode comprises a first bulk electrode in the first basket and the second electrode comprises a second bulk electrode in the second basket.

* * * * *